US005452796A

United States Patent [19]

Ohuchi

[11] Patent Number: 5,452,796

[45] Date of Patent: Sep. 26, 1995

[54] BLIND RIVET-HOLDING BELT FOR FEEDING A BLIND RIVET INTO A CONTINOUS RIVETING MACHINE

[76] Inventor: Masatoshi Ohuchi, 6-12, Shizuka-machi, Koriyama-shi, Fukushima-ken, Japan

[21] Appl. No.: 100,122

[22] Filed: Jul. 30, 1993

[30] Foreign Application Priority Data

Oct. 15, 1992 [JP] Japan ..... 4-303066

[51] Int. Cl.[6] ..... A45C 11/26

[52] U.S. Cl. ..... 206/347; 206/338; 206/346

[58] Field of Search ..... 206/346, 347, 206/485, 338

[56] References Cited

U.S. PATENT DOCUMENTS

| | | | |
|---|---|---|---|
| 3,450,255 | 6/1969 | Mosetich | 206/347 |
| 3,841,472 | 10/1974 | Fuller et al. | 206/485 |
| 3,885,669 | 5/1975 | Potucek | 206/347 |
| 4,349,106 | 9/1982 | Bogel | 206/347 |
| 4,606,455 | 8/1986 | Grikis et al. | 206/347 |
| 5,090,607 | 2/1992 | Ohuchi et al. | 206/347 |
| 5,096,061 | 3/1992 | Wakai | 206/347 |

*Primary Examiner*—David T. Fidei

*Attorney, Agent, or Firm*—Lackenbach Siegel Marzullo & Aronson

[57] ABSTRACT

Although the conventional continuous riveting machine was able to use only a special blind rivet having a longer core stem than that of the standard blind rivet provided on the market, the recently developed improved continuous riveting machine is able to use the standard blind rivet, then the blind rivet-holding belt according to the present invention for feeding the standard blind rivet to this improved riveting machine is developed. In this blind rivet-holding belt, on the upper and lower edges of a web, upper and lower tabs 731*a*, 731*b* are installed at predetermined intervals having a V-type groove, and the through holes 734, 737 are shaped on each of the tabs respectively for supporting a core stem and main body of the blind rivet, and the openings for guiding the blind rivet into the through holes are also provided on each of the upper and lower tabs.

4 Claims, 20 Drawing Sheets

BLIND RIVET-HOLDING BELT FOR FEEDING A BLIND RIVET INTO A CONTINOUS RIVETING MACHINE

BACKGROUND OF THE INVENTION

The present invention relates to a blind rivet-holding belt for a continuous riveting machine enabling continuous riveting of blind rivets.

Up to the present, single rivet-loading riveters were constructed so that blind rivets were loaded into the under portion of the nose piece of the riveter one by one for every riveting operation, and the torn core stems of that blind rivet were discharged from the upper portion of the riveter, as disclosed in prior art laid open as Japan Patent Application No. Showa 61 (1986)-78526.

However, in this riveter, as the blind rivet must be inserted for every riveting operation, the riveter was cumbersome to operate and the discharged torn core stems were dispersed around the working place.

In order to overcome the above-mentioned disadvantages, the applicant of the present invention invented the improved continuous riveting machine which enabled continuous loading of the blind rivets, prevented the dispersion of torn core stems by discharging them outwards together with a blind rivet-holding belt. This improved continuous riveting machine is disclosed in Japan Patent Application No. Heisei 3 (1991)-152150.

Further, the blind rivet-holding belt applicable to the above improved continuous riveting machine was disclosed in Japan Patent Application No. Heisei 4 (1992)-76367. As shown in FIG. 5 to FIG. 8, this blind rivet-holding belt 100 is a long body made of plastic material and is shaped generally like a channel in sectional view, and on the upper and bottom edges of a web of the belt, a plural of rectangular tabs 101 are integrated in one piece with the web at the predetermined interval having a groove 103 on the halfway part thereof. Further on said web, a plural of rectangular feed holes 105 is shaped at the predetermined interval for engaging with a feed pawl.

On the portion near the tip of each of the upper and lower tabs 101 are provided a through hole 104, and two slits 106 radially started from the through hole 101 and reaching the small holes 107.

Each diameter of the through holes 104 shaped on each of the upper and lower tabs is bored so as to be a little smaller than the core stem 33*a* of the blind rivet. However, only the upper tab 108 has an opening 110 connected to the through hole 109 and opened to the tip of the tab as shown in FIG. 9.

Then, in order to continuously rivet the blind rivet by applying above-mentioned blind rivet-holding belt 100, the improved continuous riveting machine disclosed in the aforementioned Japan Patent Application No. Heisei 3(1991)-152150 is applied.

As shown in FIG. 21 to FIG. 22, this continuous riveting machine is comprised of a main body section A, a driving section B and a rivet supply section C.

By combining FIG. 21 with FIG. 22, the improved continuous riveting machine with an operating lever released is displayed as a whole.

By combining FIG. 23 with FIG. 25, or FIG. 24 with FIG. 25, the improved continuous riveting machine with an operating lever gripped is shown as a whole.

While the air piston 2 is in the far most advanced position as shown in FIG. 25, each position of the miscellaneous pistons located in the main body section A and the position of the blind rivet are transferred from the state shown in FIG. 23 to that shown in FIG. 24.

The drive section B is composed of a small diametral hydraulic cylinder 12 and a large diametral air cylinder 1 connected to the hydraulic cylinder 12. This hydraulic cylinder 12 is branched sideways and a little upwardly oblique from the main body section A, and is integrated in one piece with a pneumatic and hydraulic cylinder 5. A piston rod 3 integrated in one piece with a piston 2 is inserted in the air cylinder 1 and slidably inserted in the hydraulic chamber 12*a* so as to be serviceable as a piston of the hydraulic cylinder 12.

In the under portion of the air cylinder 1, a shaft hole 41 is shaped and connected to an air exiting port 40 located on the under portion of the air cylinder 1, and a valve chamber 44 is shaped at the rear end of the shaft hole 41. Both enlarged portions of the shaft hole 41 are connected to the air cylinder 1 through connecting paths 42 and 43. Also in the shaft hole 41, a valve shaft 6 having a value 8 for closing the path 43 at the rear end thereof, and a plug 70 for closing the shaft hole 41 at the front end thereof, are slidably inserted. The valve shaft 6 is usually energized to move forwardly by a spring 25.

A trigger lever 9 and a valve cam 10 are pivotally supported by spring pins 45 and 46 biasing them to rotate clockwise, and the operating lever 9 and the valve cam 10 are connected together with a connecting rod 11 by spring pins 47, 48 pivotally placed on the upper portion of the lever 9 and the valve cam 10. Further, the lower tip of the valve cam 10 contacts the front face of the plug 70.

In the main body section A, a cylindrical rivet nose 18 is connected to the bottom portion of a pneumatic hydraulic cylinder 5 integrated in one piece with the hydraulic cylinder 12-through a chuck cylinder 73. Inserted into the pneumatic hydraulic cylinder 5 is a pneumatic-hydraulic piston 13 dividing the inner portion of the cylinder 5 into an upper air chamber 5*b* and a lower hydraulic oil chamber 5*a*, and a cylindrical body 13*a* is integrally shaped in one piece with the under portion of the pneumatic hydraulic piston 13 and the air chamber 5*b* connected to an air chamber 72 shaped at the rear end of the valve chamber 44 of the drive section B through the air pipe 71, and the oil chamber 5*a* is connected to the oil chamber 12*a* of the hydraulic oil cylinder 12.

In the chuck cylinder 73, a hollow chuck piston 75 having a cylindrical body 74 integrally shaped with the piston 73 is inserted. In the cylindrical body 13*a* of the pneumatic hydraulic piston 13, a coil spring 76*a* is inserted, and a rod 76 energized downwardly by the coil spring 76*a* is retractably extruded from a bottom wall of the cylindrical body 13*a*. On the lower tip of the rod 76, a hollow jaw case 77 moving slidably in the cylindrical body 74 of the chuck piston 75 is installed.

In the lower inner surface of the jaw case 77 is shaped a tapered circular surface 78 converging downwardly. A pair of jaws 14 are slidably inserted in the surface 78. Each of the jaws 14 is downwardly and outwardly energized by a spring 79 inserted in said jaw case 77 through a jaw pusher 80 having a V-shaped tip. Further, the bottom end of the cylindrical body 74 is closed except the hole for allowing passage of the core stem of the blind rivet, and each tip of said jaw case 77 and the jaws 14 contact with the bottom wall 74*a* of the body 74 in the state shown in FIG. 21 and FIG. 22.

The air chamber 81 positioned under the chuck piston 75 inserted in the chuck cylinder 73 is connected to the air port 82 located on the front end of the air cylinder 1 of the drive section B through an air supply pipe 83. Also, as shown in FIG. 29, in the bottom inner portion of the rivet nose 18, a pair of nose pieces 19 are pivotally supported and biased inwardly by a pair of springs 29 mounted on a pair of set screws 51.

In FIG. 29, numeral 53 identifies a pair of rivet passing holes for the blind rivet 33, and numeral 100 identifies the blind rivet-holding belt described above.

As shown in FIG. 5 to FIG. 8, the blind rivet-holding belt 100 is shaped as a channeled section made of polypropylene, and has a plural of feed holes 105*d* and upper and bottom tabs at Every specified distance.

The rivet supply section C is composed of a rivet feed air cylinder 58 integrally installed on the side surface of the rivet nose 18, and a guide plate 59, as shown in FIG. 26 to FIG. 29. In FIG. 27, a piston 22 forwardly biased by a spring 31, is inserted in the rivet feed air cylinder 58, and in the piston 22 a shaft 23 having a feed pawl 23a is inserted and fixed by a screw 23b for preventing said shaft 23 from falling out. As shown in FIG. 24 the rivet feed air cylinder 58 is connected to the port 81a located on the upper portion of the chuck cylinder 73 through an air pipe 84.

In FIG. 26 and FIG. 27, numeral 58*a* identifies an air port connected to the air pipe 84.

The guide plate 59 has a pair of extrusions 60, 60 located on the upper and lower edges of the guide plate 59 for guiding the blind rivet-holding belt 100, a long hole 61 shown in FIG. 21, FIG. 23, FIG. 24, FIG. 27 and FIG. 28 for guiding the feed pawl 23*a*, and a nail 59*a* for preventing reverse motion of the blind rivet-holding belt 100 protruding therefrom. Numeral 20 in FIG. 29 is a blind rivet-holding belt-pressing plate, and is installed in the rivet nose 18 through a pair of pistons 21 and a pair of biasing springs 30, 30 for elastically pushing the blind rivet-holding belt 100 against the guide plate 59. Also, a covering plate 30*a* fixed on the rivet nose 18 by screw threads (not shown) presses the springs 30 toward the pistons 21. Numeral 34 is a magazine for containing the blind rivet-holding belt 100.

This rivet-containing magazine 34 is shaped in cylindrical form having a vertical axis against the longitudinal direction of the guide plate 59, then the blind rivet-holding belt 100 is wound spirally along said inner cylindrical wall, and is fed out along the guide plate 59.

The working of this improved continuous riveting machine constructed as described above in detail, is next described as follows.

The blind rivet-holding belt 100 is usually contained in the magazine 34, and before riveting, this riveting machine is in the state shown in FIG. 21. Namely, the operating lever 9 is released, and the blind rivet 33 is extruded downwardly from the bottom of the opened nose pieces 19.

In this condition, after the air supply port 40 (shown in FIG. 22) is connected to the pressurized air supply source (not shown), the main body of the blind rivet 33 is put in the hole of the steel sheets 63 to be riveted as shown in FIG. 21. Then by gripping the operating lever 9, the valve shaft 6 and the valve 8 go back, as the valve cam 10 rotates counter-clockwise through the connecting rod 11 as shown in FIG. 25. As pressurized air is introduced into the air cylinder 1 through the connecting hole 43, the piston 2 advances, the hydraulic oil in the oil chamber 12*a* is supplied in the oil chamber 5*a*, and the pneumatic hydraulic piston 13 is raised to the top dead position as shown in FIG. 23.

Accordingly, the rod 76 and the jaw case 77 are raised upwardly. In this state, as a pair of jaws 14 are being biased downwardly by the spring 79 through the jaw pusher 80, the jaws 14 are slidably and downwardly extruded along the tapered surface 78 shaped on the jaw case 77 and go up while gripping the core stem 33*a* of the blind rivet 33. By pulling up the core stem 33*a*, the riveting action of the blind rivet 33 is performed. The core stem 33*a* is then torn from the blind rivet 33 at the position equivalent to the tip position of the nose piece 19.

As shown in FIG. 25, when the piston 2 reaches the stroke end, the pressurized air in the air cylinder 1 is supplied to the air chamber 81 from the air port 82 through the air pipe 83 shown in FIG. 24.

Accordingly, as also shown in FIG. 24, while the chuck piston 75 and the cylindrical body 74 rise up, at first a liner 74a in the body 74 contacts the tips of the jaws 14 and pushes up the jaws 14, then contacts the tip of the jaw case 77, and the jaws are accordingly opened.

Then, the cylindrical body 74 further rises from that position and the jaw case 77 also rises while compressing the bias spring 76*a*, and reaches the condition shown in FIG. 24.

When the chuck piston 75 reaches the top dead position, the pressurized air filled in the chuck cylinder 73 through the air pipe 83 is supplied to the rivet feed air cylinder 58 through the port 81*a*, the air pipe 83 and the port 58*a*. As shown in FIG. 27, the piston 22 then moves in the direction indicated by arrow, the feed pawl 23*a* installed on the tip of the shaft 23 moves along the long hole 61, and then the feed pawl 23*a* engaged with the feed hole 105 of the blind-rivet-holding belt 100 transfers the holder 100 as much as one pitch, and sets the tip of the blind rivet 33 in the specified position in the rivet nose 18. (See FIG. 24).

Next, by releasing the operation lever 9, as shown in FIG. 22, owing to the clockwise rotation of the valve cam 10, the valve 8 is closed by the biasing force of the spring 25, the pressurized air is supplied into the air chamber 5*b* of the pneumatic-hydraulic cylinder 5 through the air chamber 72, the air pipe 71, as shown in FIG. 21, then the rod 76, the jaw case 77, the pneumatic-hydraulic piston 13, the chuck piston 75 and the cylindrical body 74 are pushed downwardly to the lower limit positions. In this case, as shown in FIG. 21, as the upper portion of the core stem 33*a* of the blind rivet 33 is inserted between a pair of jaws 14, 14, and contacts the bottom end of the jaw pusher 80, the blind rivet 33 is pushed downwardly. After opening a pair of the nose pieces 19, the rivet 33 stops in the position of being extruded from the nose piece 19.

In this condition, as the pressurized air supply to the air cylinder 58 is exchanged and air pressure in the cylinder 58 is exhausted, the piston 22 of the rivet feed air cylinder simultaneously moves towards the left side as shown in FIG. 27 (in FIG. 21, it moves towards the right). However, the blind rivet-holding belt 100 is prevented from reverse motion by the nail 59*a*, and only the feed pawl 23*a* disengaged from the feed hole 105 of the blind rivet-holding belt 100 moves backwardly as much as one pitch as said holder 100 remains at the present position, and again engages with the feed hole 105*d* positioned backwardly as much as one pitch.

According to the above description, one blind rivet 33 is riveted, and by repeating the aforementioned operation, it is possible to perform continuous riveting.

Also, as shown in FIG. 21, FIG. 23 and FIG. 24, the torn core system 33*a* is continuously discharged while being inserted in the through hole of the holder 100 through the pass hole 53 shown in FIG. 29.

If the blind rivet-holding belts 100 in the containing magazine 34 are consumed, or if using the riveting machine originally charged with the holder 100 therein, the blind rivet 33 first placed on the head position of the rivet-holding belt 100 is placed on the position shown in FIG. 30, then by gripping the operating lever 9, raising the pneumatic hydraulic piston 13 and the chuck piston 75 simultaneously the blind rivet 33 is fed into the specified position.

In this case, the bottom end of the cylindrical body 74 and the blind rivet 33 are located in the positions shown in FIG. 24.

Next, by releasing the operating lever 9, the pneumatic-hydraulic piston 13 and the chuck piston 75 are pushed downwardly, the blind rivet 33 opens a pair of the nose pieces 19, 19 and extrudes from the bottom surface of these pieces 19, and all riveting preparations are finished.

The preceding actions are performed according to the above-described process. However, in this continuous riveting machine described above there existed the following drawbacks.

The length of the core stem 33*a* of the blind rivet 33 applicable to this riveting machine is longer than that of the standard blind rivet provided on the market.

As the torn core stems 33*a* are discharged together with the rivet holding-belt 100 while being kept between the tabs of the holding belt, there are drawbacks such as injury to the operator's hands, and extrusion from the dust bag and bulkiness. Furthermore, it is cumbersome to separate the torn core stems made of metal and the holding belt made of plastics such as polypropylene when disposing of them.

The present invention was developed in consideration of the above-mentioned drawbacks, and its object is to provide a blind rivet-holding belt able to solve the above-mentioned drawbacks by constructing it as follows, namely, while descending a nose piece attached in the bottom portion of a cylindrical body of a continuous riveting machine, upper and lower tabs of the blind rivet-holding belt are bent downwardly by the tip portion of the nose piece, and the blind rivet is simultaneously disengaged from the belt by slipping out from the opening adjacent to the through holes, then securely gripped by the jaws of the riveting machine.

SUMMARY OF THE INVENTION

The blind rivet-holding belt according to the present invention is made of plastic material and shaped generally like a channel having long web bored feed holes at predetermined intervals and tabs integrated in one piece with the upper and lower edges of the web at predetermined intervals having a groove in the halfway of the interval. In the upper tab, a through hole is bored for holding a core stem of a blind rivet and in the lower tab a through hole is also bored for holding a main body of the blind rivet. An opening opened toward the tip of the tab from each of the through holes is shaped on each of the upper and lower tabs. Further, the groove is shaped so that the tabs do not interfere with each other when the long plastic belt is spirally wound in the predetermined diameter as said web is oriented outwardly. Accordingly, the groove should be V-shaped, but it may be possible to shape the groove like a slit. Furthermore, the openings of the tabs are shaped a little narrower than each diameter of the core stem and main body of the blind rivet.

As the openings are oriented from the through holes bored on the upper and lower tabs, when the cylindrical body descends while gripping the core stem by the jaws inserted in the cylindrical body, the nose piece inserted in the bottom portion of the cylindrical body downwardly bends the upper and lower tabs, and the blind rivet is released from the through holes of the tabs.

BRIEF DESCRIPTION OF THE DRAWINGS

FIG. 21 shows the operating lever installed in the machine being released.

DETAILED DESCRIPTION OF THE INVENTION

Figure 1:
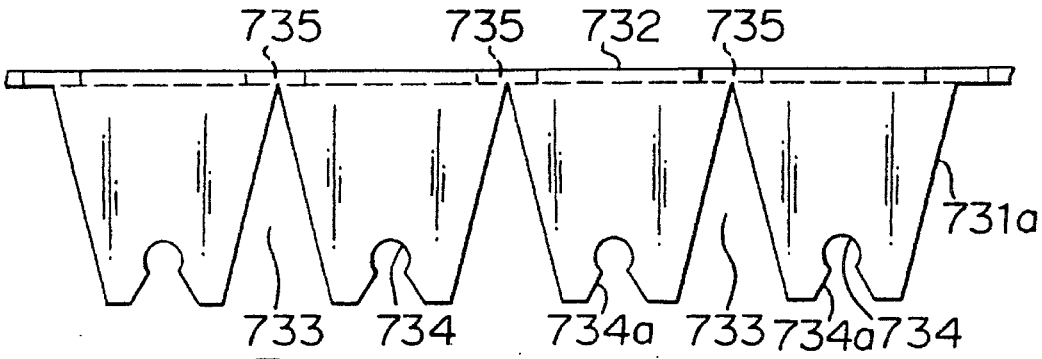
FIG. 1 shows a plan view of the embodiment of the blind rivet-holding belt according to the present invention.
Figure 2:
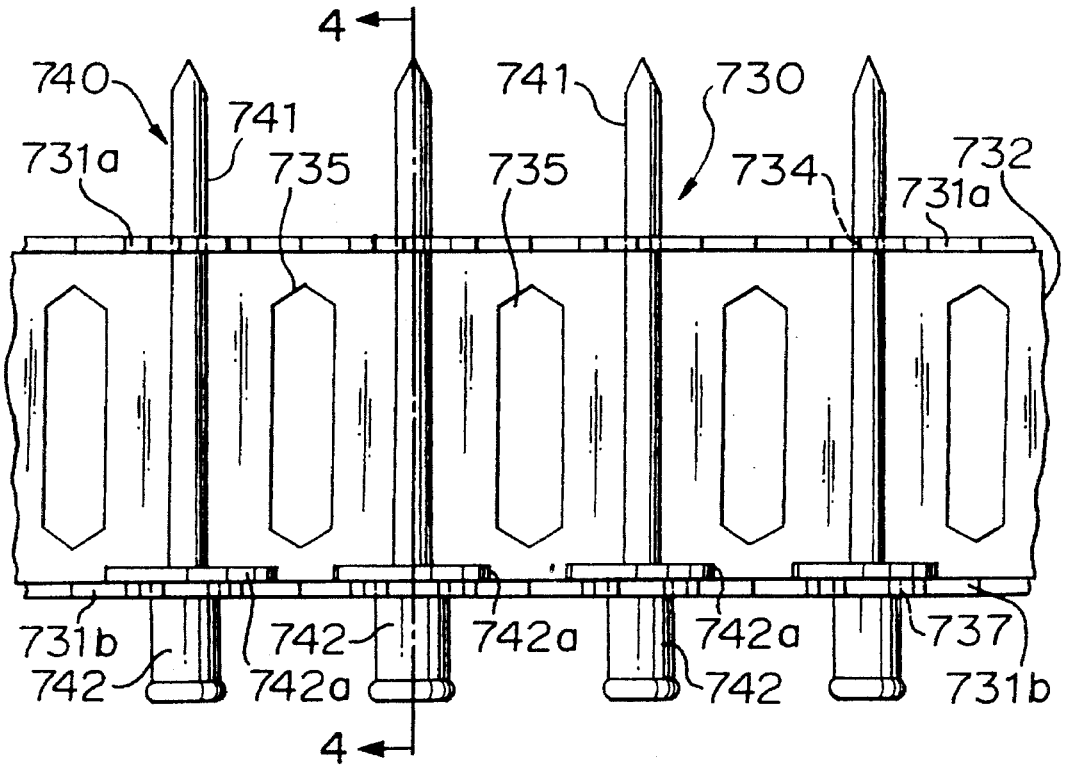
FIG. 2 shows an elevational view of the embodiment shown in FIG. 1.
Figure 3:
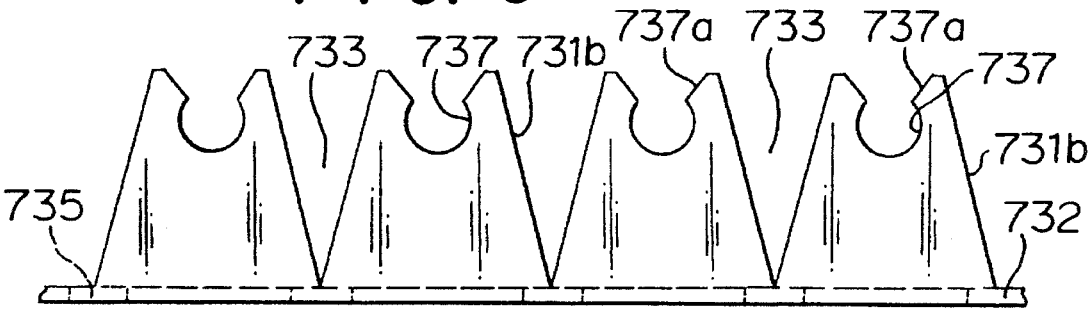
FIG. 3 shows a bottom view of the embodiment shown in FIG. 1.

The foregoing and other objects, features and advantages of the present invention will become more apparent from a reading of the following detailed description in connection with the accompanying drawings.

The plan view, the elevational view, the bottom view, and the sectional side view of the embodiment of the blind rivet-holding belt according to the present invention are shown in FIG. 1 to FIG. 4.

The blind rivet-holding belt 730 according to the present invention is comprised of a long body made of plastic material as shown in FIG. 1 to FIG. 4. The sectional form thereof is generally shaped like a channel, and on both edges of the web, a plurality of the upper tabs 731*a* and bottom tabs 731*b* are integrated in one piece at predetermined intervals each having a groove 733, and a plurality of the feed holes 735 are shaped on the web 732 at the predetermined intervals.

Furthermore, a through hole 734 is provided in each 731a for holding a core stem 741 of the blind rivet 740, and a through hole 737 is provided in each lower tab 731*b* for holding a main body 742 of the blind rivet 740.

Each V-shaped which open 734*a* and 737*a* opened toward each outer edge of the tabs is connected to each of the through holes 734, 737, and each base end of the openings is shaped a little narrower than each of the diameters of the rivet core stem 741 and the rivet main body 742.

The grooves 733 are V-shaped to prevent the interference of the tab with the neighboring tab, when the blind rivet-holding belt is spirally wound in the specified diameter so that the web is oriented outwardly.

However, it may be possible to use the belt as a straight cartridge type by shaping the grooves as slits.

Figure 4:
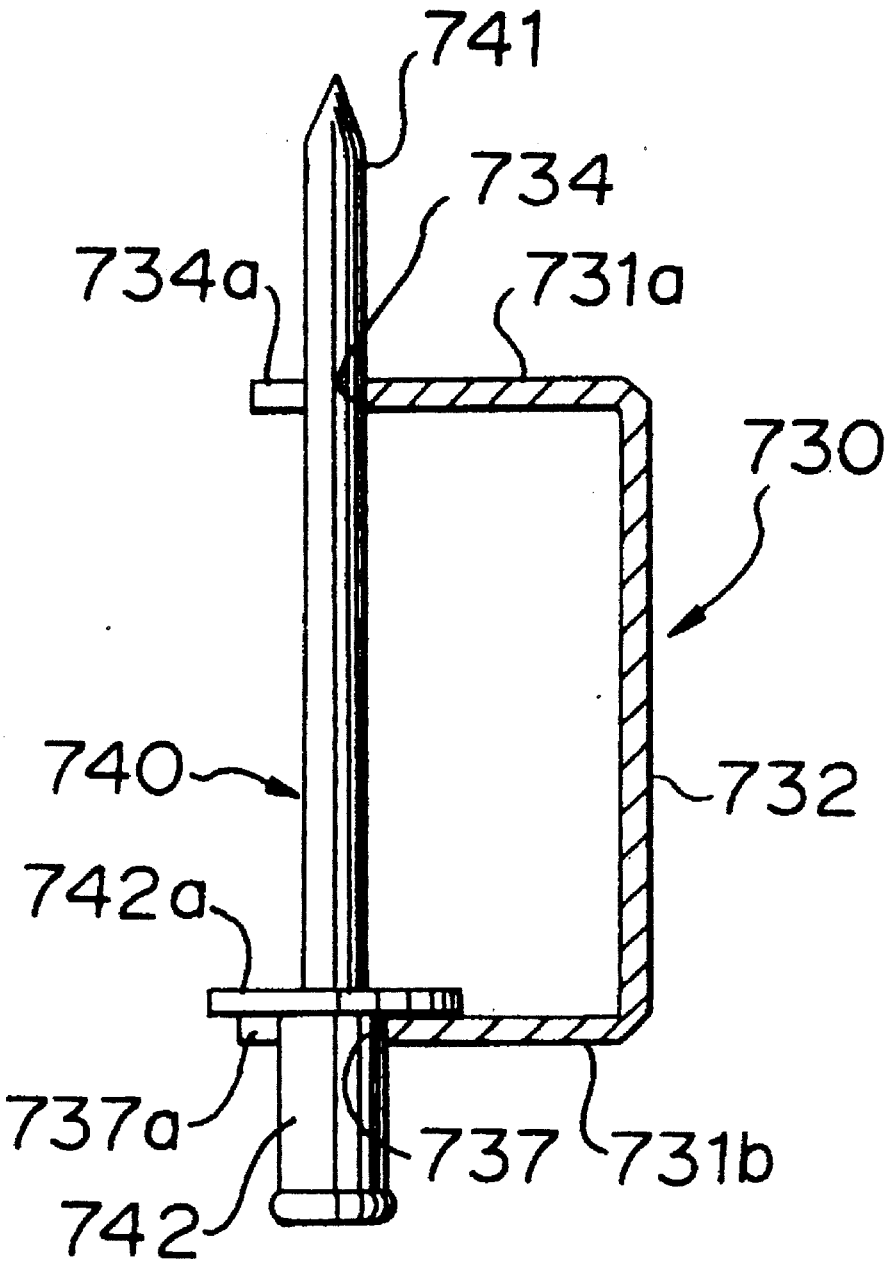
FIG. 4 shows a sectional view taken along line 4—4 shown in FIG. 2.
Figure 5:
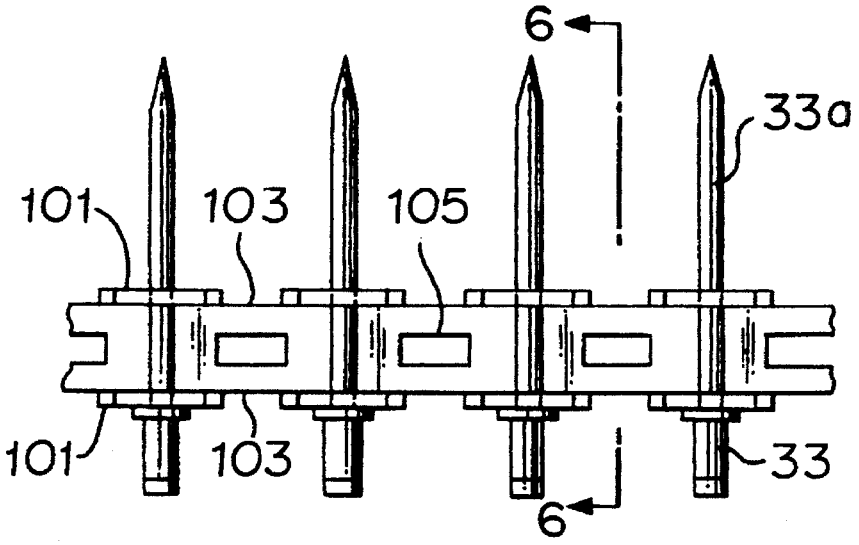
FIG. 5 PRIOR ART
FIG. 5 shows a plan view of the conventional blind rivet-holding belt.
Figure 6:
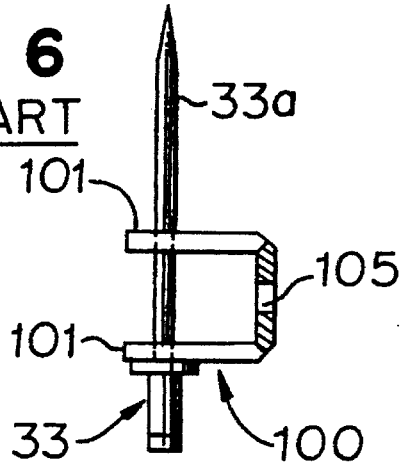
FIG. 6 PRIOR ART
FIG. 6 shows a sectional view taken along line 6—6 shown in FIG. 5.
Figure 7:
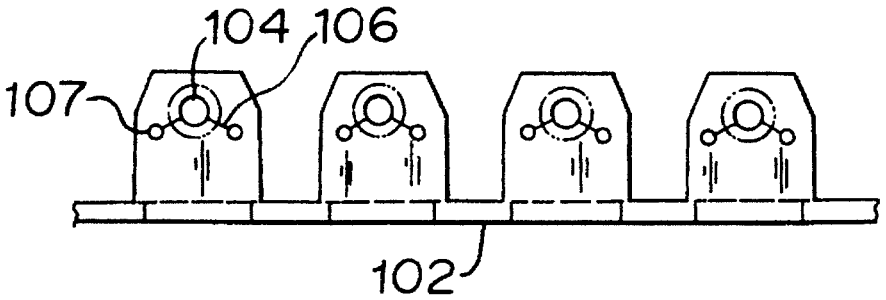
FIG. 7 PRIOR ART
FIG. 7 shows a bottom view of the rivet-holding belt shown in FIG. 5.
Figure 8:
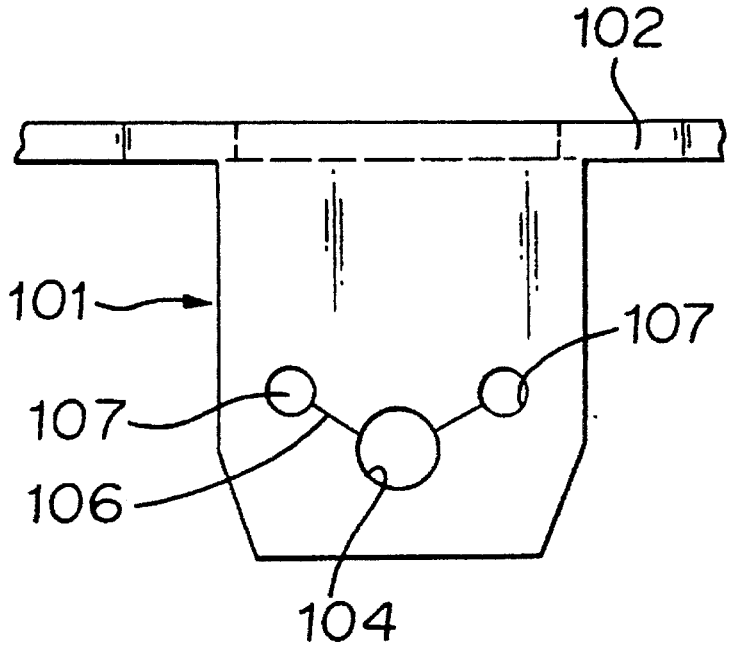
FIG. 8 PRIOR ART
FIG. 8 shows a plan view of another type of conventional rivet-holding belt.
Figure 9:
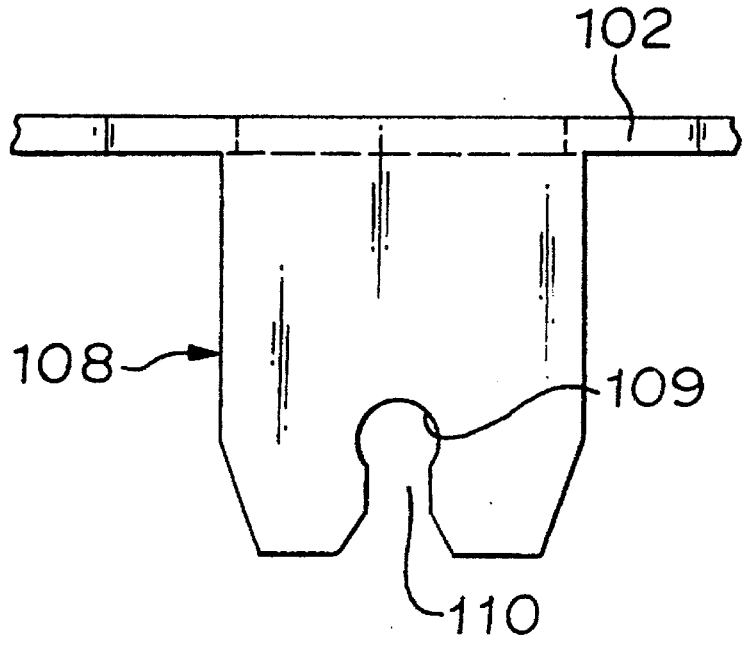
FIG. 9 PRIOR ART
FIG. 9 shows a plan view of one other type of conventional rivet-holding belt.

Although the blind rivet is held in the conventional blind rivet-holding belt so that the rivet core stem is penetrating through the through holes of each of the upper and lower tabs thereof and the head 33*c* of the main body 33*b* of the blind rivet is placed out of the external side of the lower tab 101 as shown in FIG. 6, in the blind rivet-holding belt according to the present invention, as shown in FIG. 4, the head portion 742*a* of the blind rivet is placed on the inner side of the lower tab 731*b*.

The continuous riveting machine applying the blind rivet-holding belt according to the present invention is next described as follows.

Figure 10:
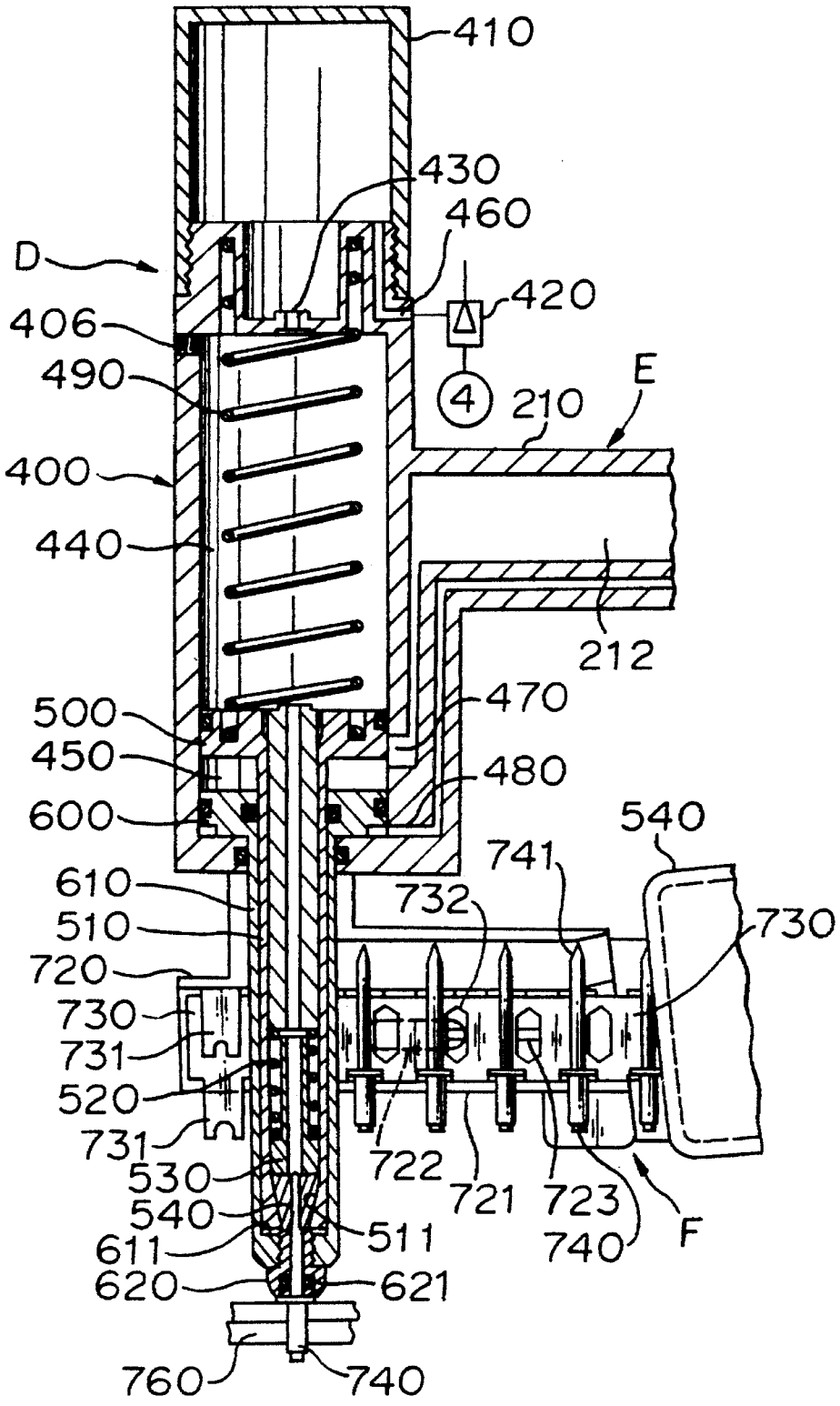
FIG. 10 shows a sectional view of the main body section and the rivet-supply section of the continuous riveting machine applying the rivet-holding belt according to the present invention, and shows the operating lever released, and the trigger valve set in the normal position.
Figure 11:
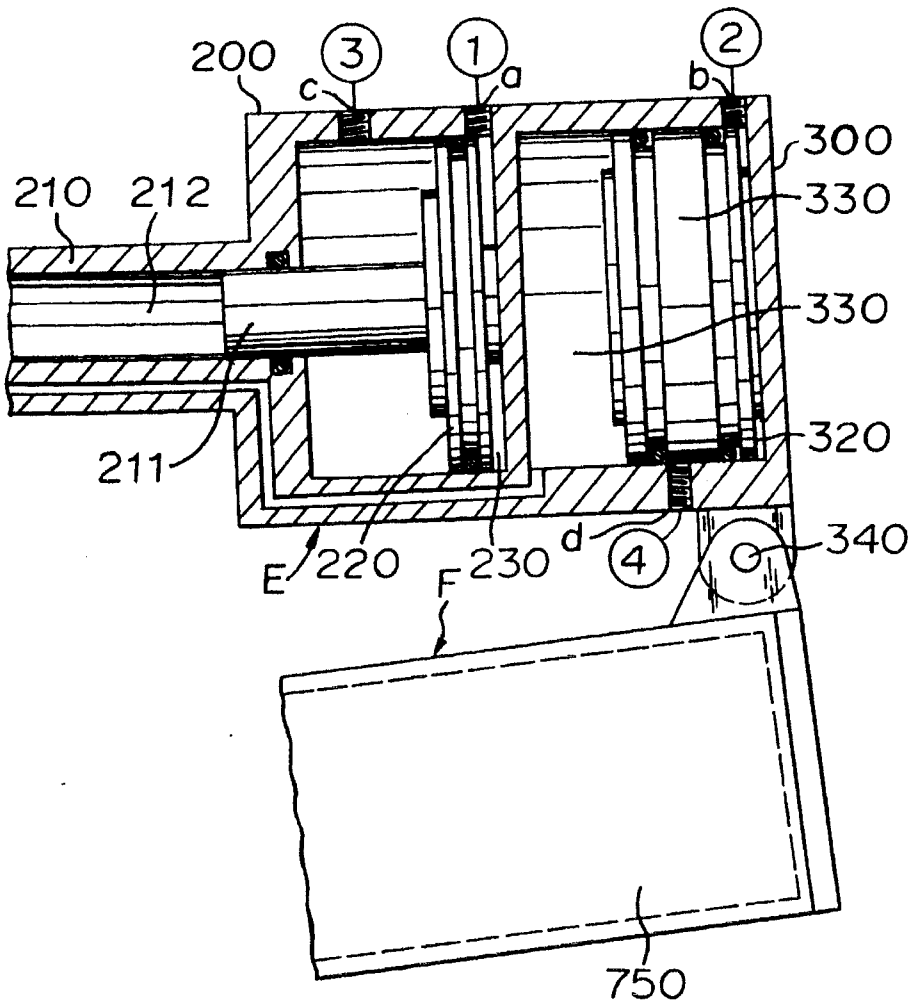
FIG. 11 shows a sectional view of the pneumatic and hydraulic cylinder of the continuous riveting machine applying the rivet-holding belt according to the present invention.
Figure 12:
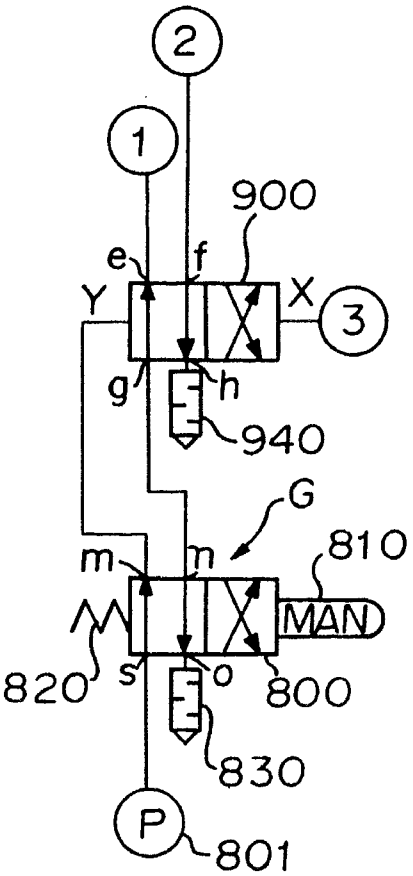
FIG. 12 shows an air-piping system applied to the continuous riveting machine applying the rivet-holding belt according to the present invention. By combining FIG. 12 with FIG. 10 and FIG. 11, the continuous riveting machine is displayed as a whole.
Figure 13:
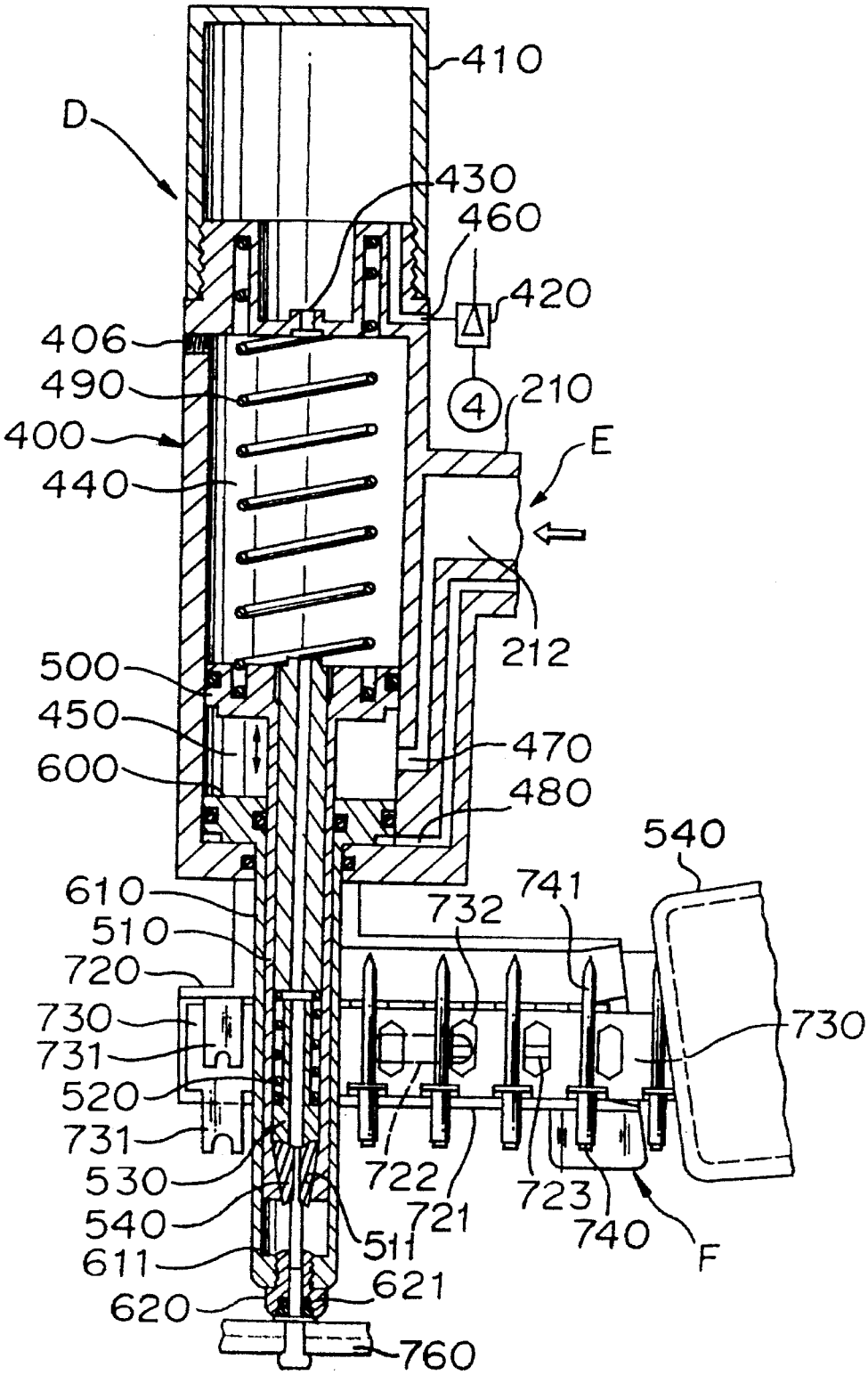
FIG. 13 shows a sectional view of the main body section and rivet supply section of the continuous riveting machine applying the rivet-holding belt according to the present invention. This drawing shows that the trigger valve is position-changed by gripping the operating lever and the position of the control valve is held in the same position shown in FIG. 12.
Figure 14:
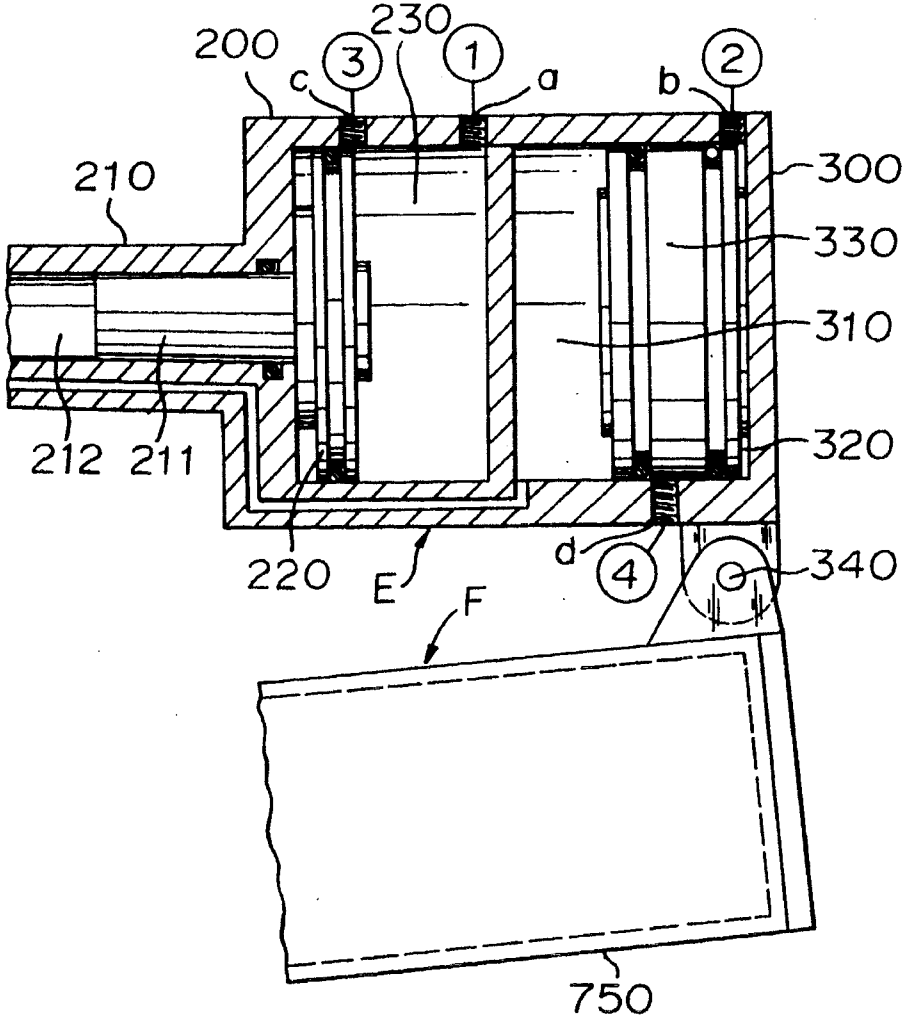
FIG. 14 shows a sectional view of the drive section of the continuous riveting machine applying the rivet-holding belt according to the present invention.
Figure 15:
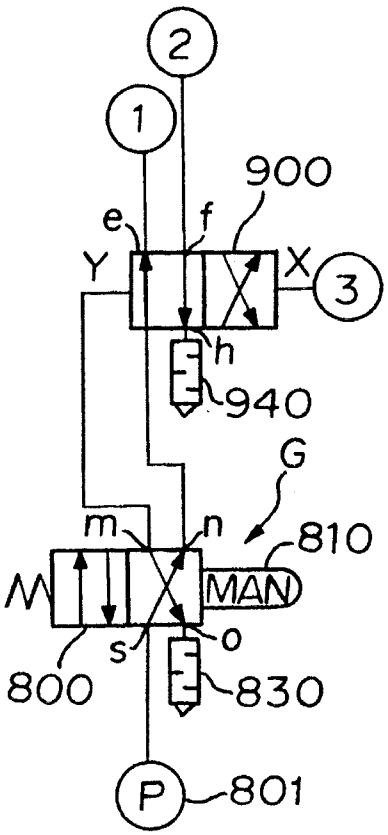
FIG. 15 shows an air-piping system adopted in the continuous riveting machine applying the rivet-holding belt according to the present invention. By combining FIG. 15 with FIG. 13 and FIG. 14, the riveting machine is displayed as a whole.
Figure 16:
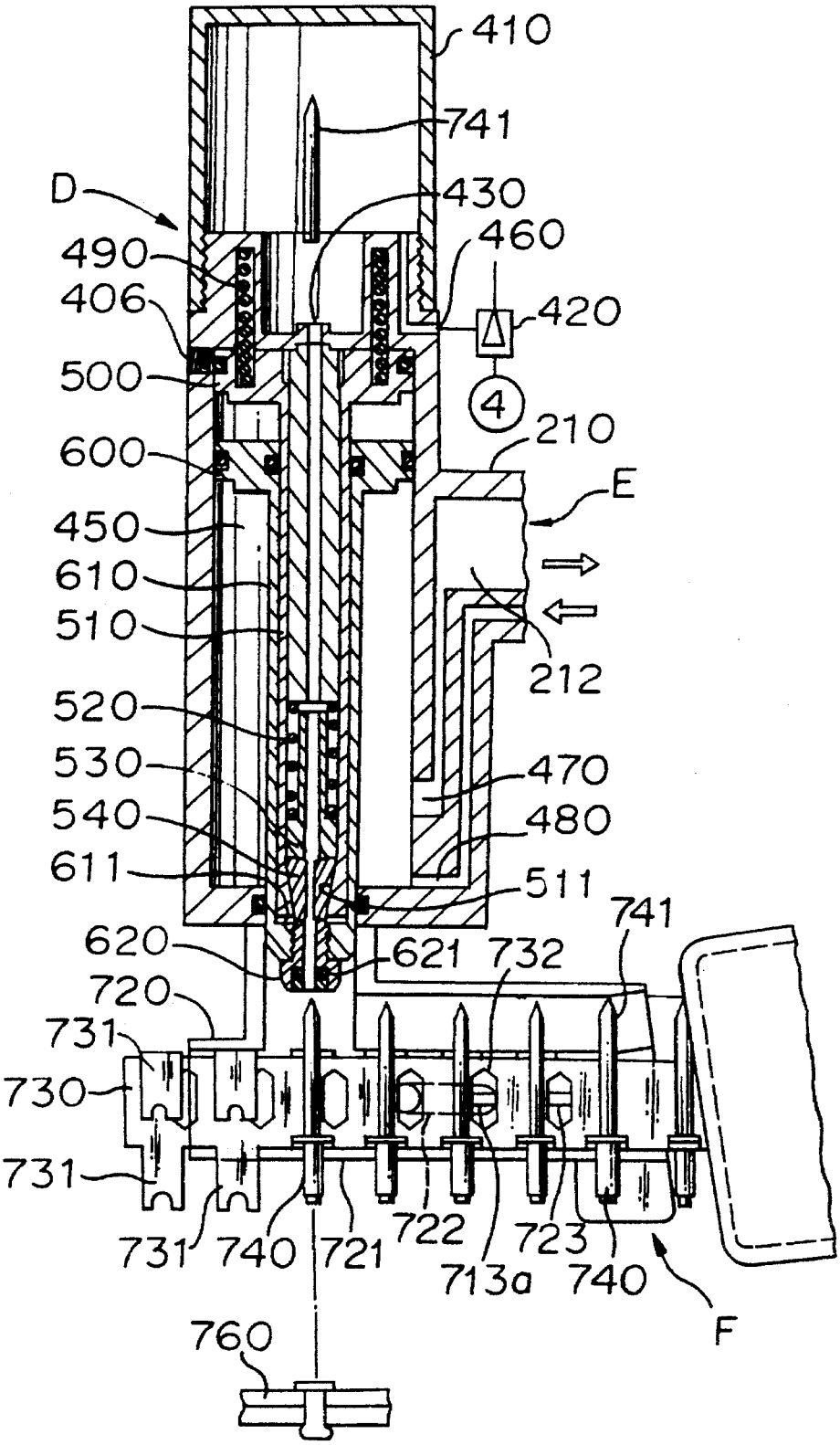
FIG. 16 shows a sectional view of the main body section and the rivet supply section of the continuous riveting machine applying the rivet-holding belt according to the present invention. This drawing shows the positions of the trigger valve and control valve having changed.
Figure 17:
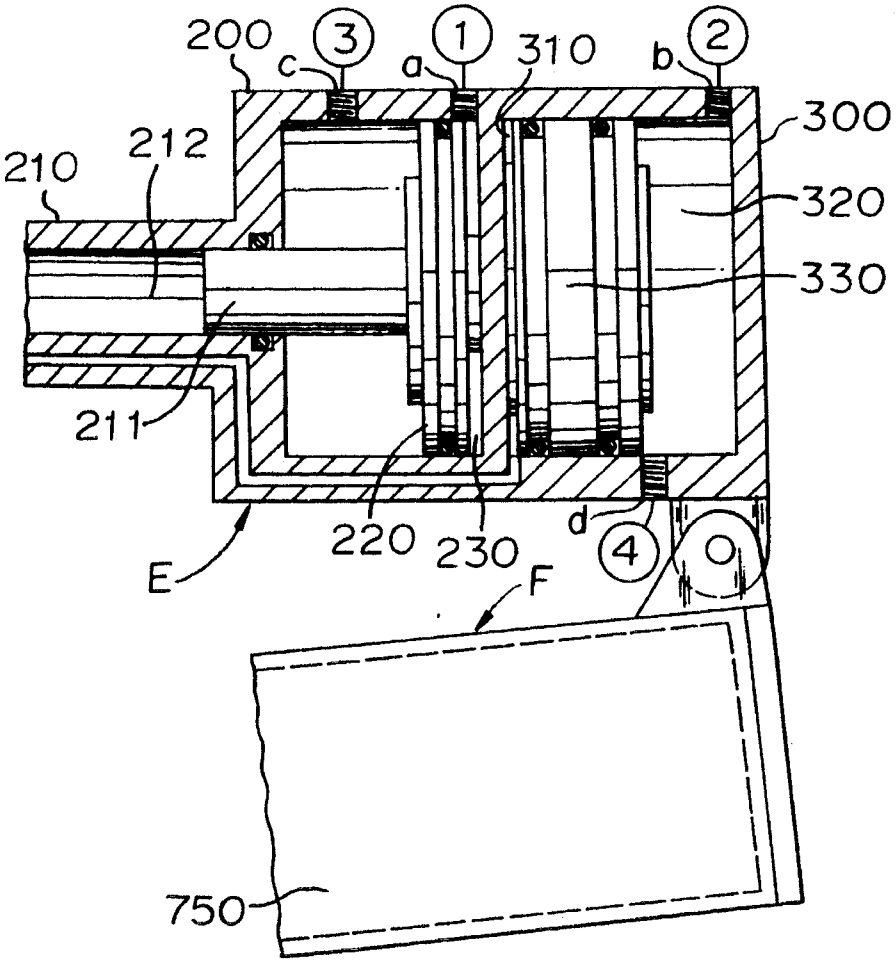
FIG. 17 shows a sectional view of the drive section of the continuous riveting machine applying the rivet-holding belt according to the present invention.
Figure 18:
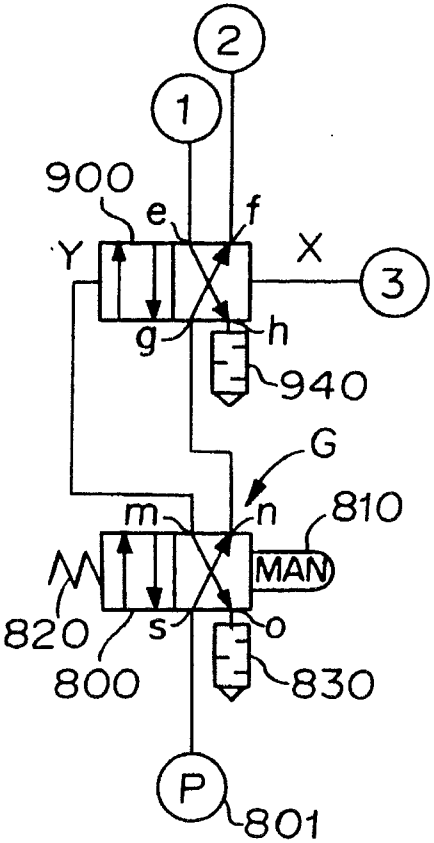
FIG. 18 shows an air-piping system adopted in the continuous riveting machine applying the rivet-holding belt according to the present invention. By combining FIG. 18 with FIG. 16 and FIG. 17, the riveting machine is displayed as a whole.
Figure 19:
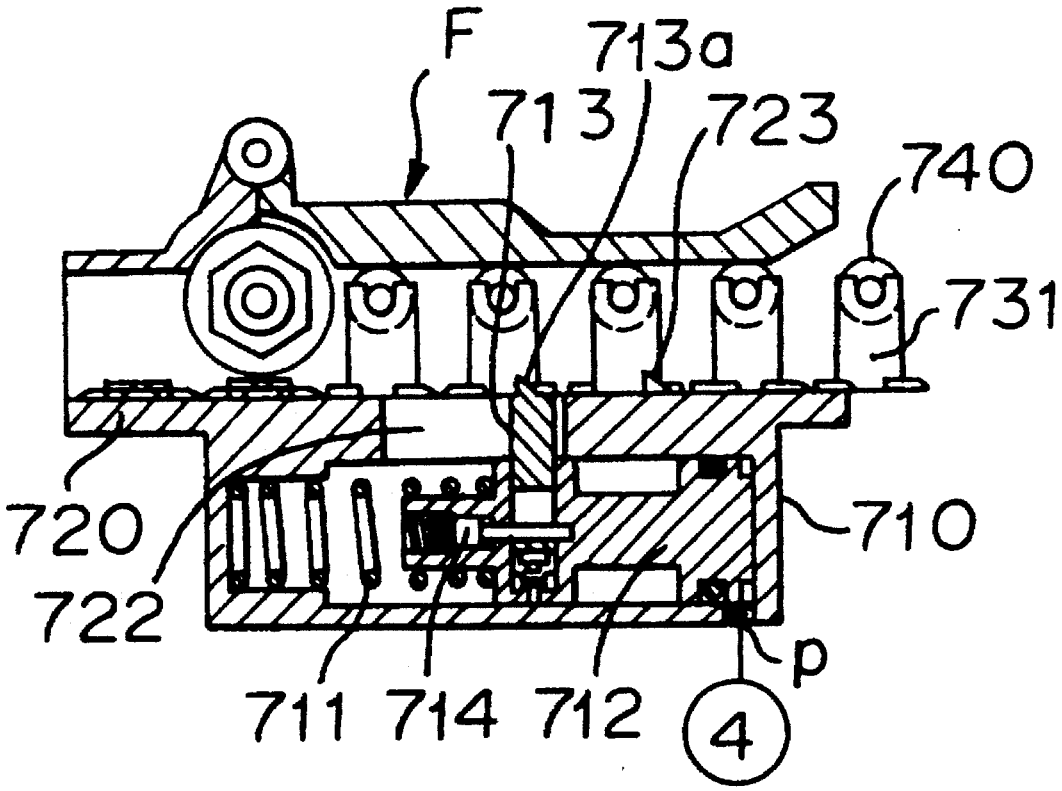
FIG. 19 shows a sectional view of the rivet-supply section of the continuous riveting machine applying the rivet-holding belt according to the present invention.
Figure 20:
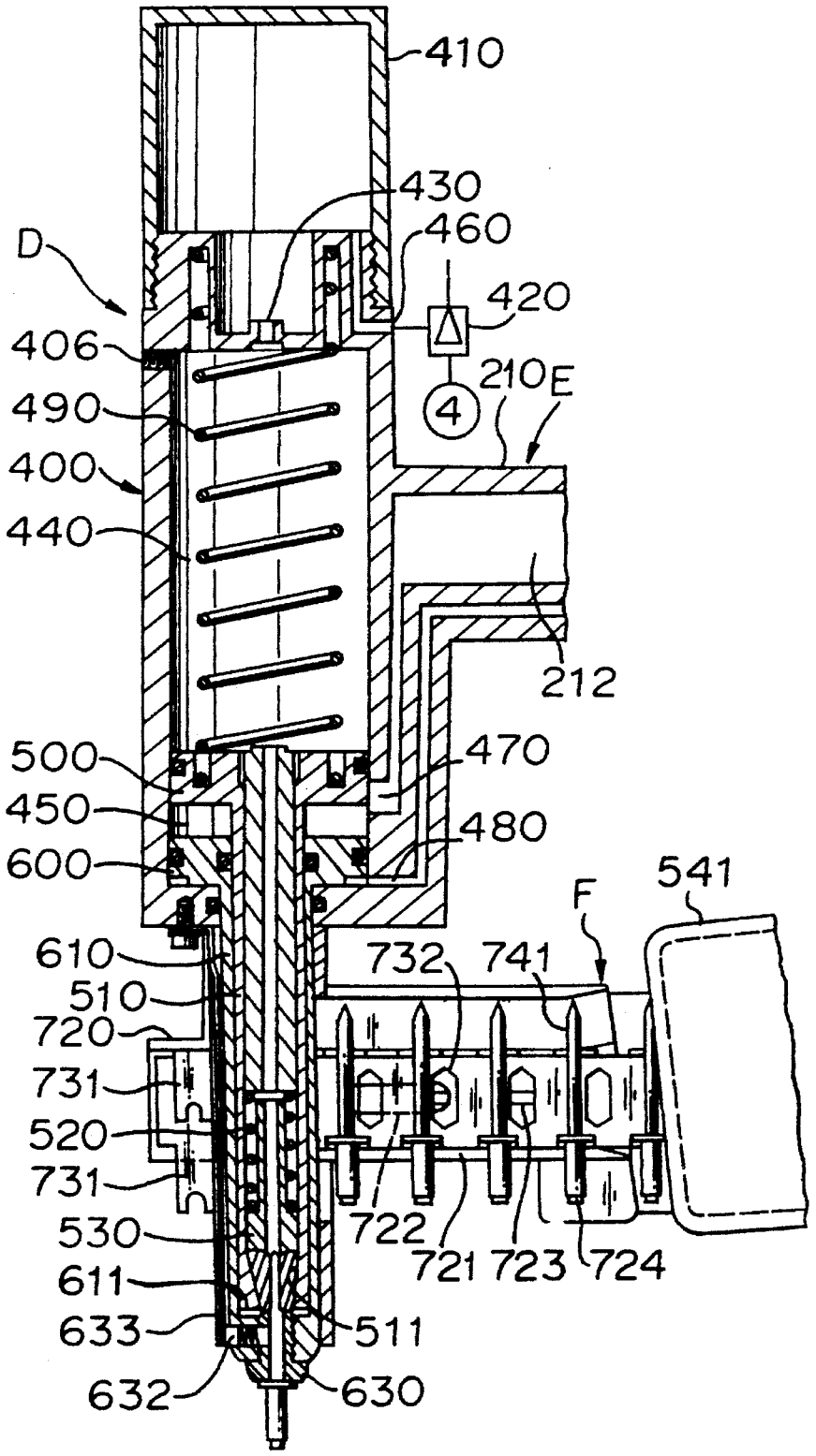
FIG. 20 shows a sectional view of the main body section and the rivet supply section of the continuous riveting machine applying the rivet-holding belt according to the present invention where the holding of the rivet core system is carried by the holding pin and the plate spring.
Figure 21:
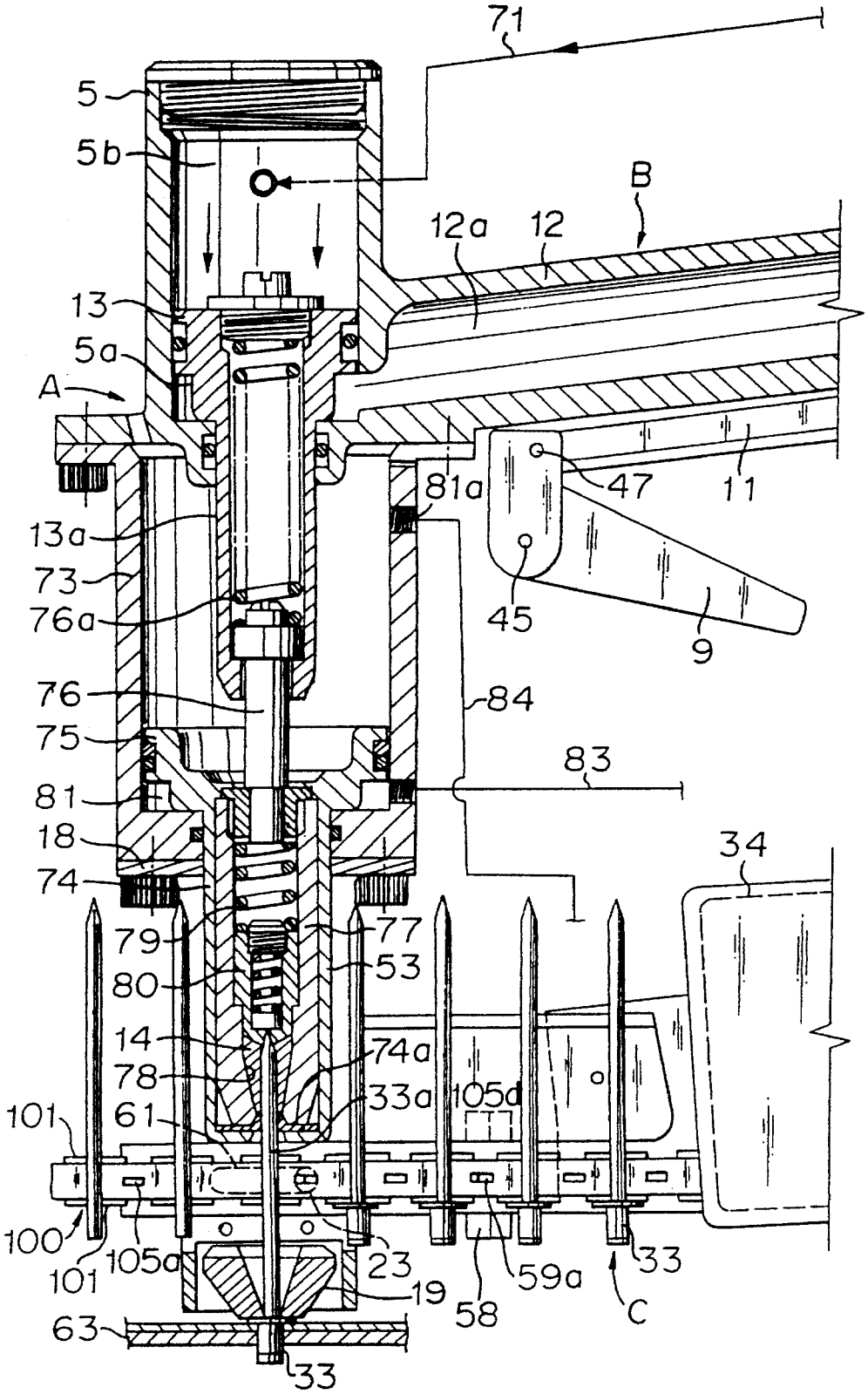
FIG. 21 shows the main body section and the rivet supply section of the unconventional riveting machine applying the conventional rivet-holding belt.
Figure 22:
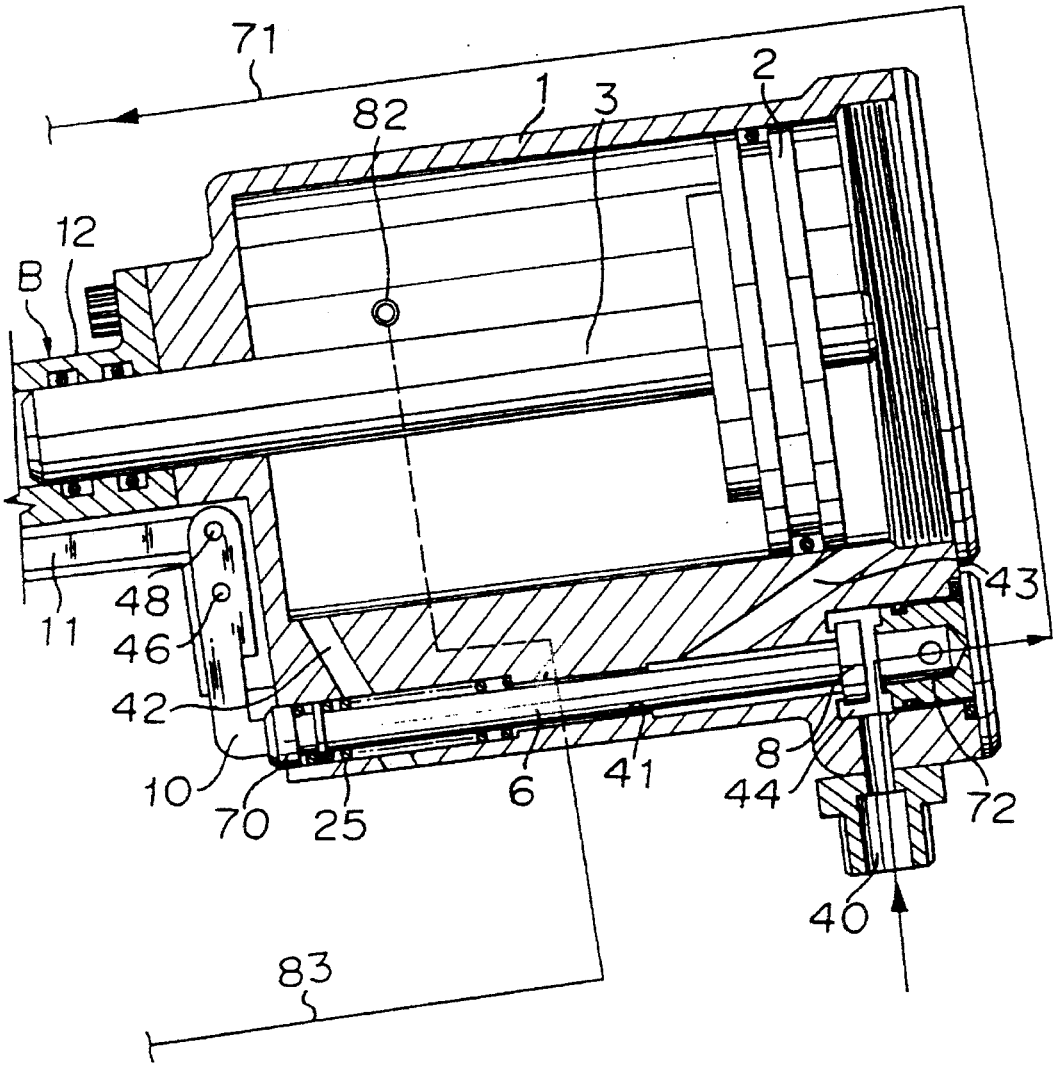
FIG. 22 shows a sectional view of the drive section of the continuous riveting machine applying the conventional rivet-holding belt. By combining FIG. 22 with FIG. 21, the riveting machine is displayed as a whole.
Figure 23:
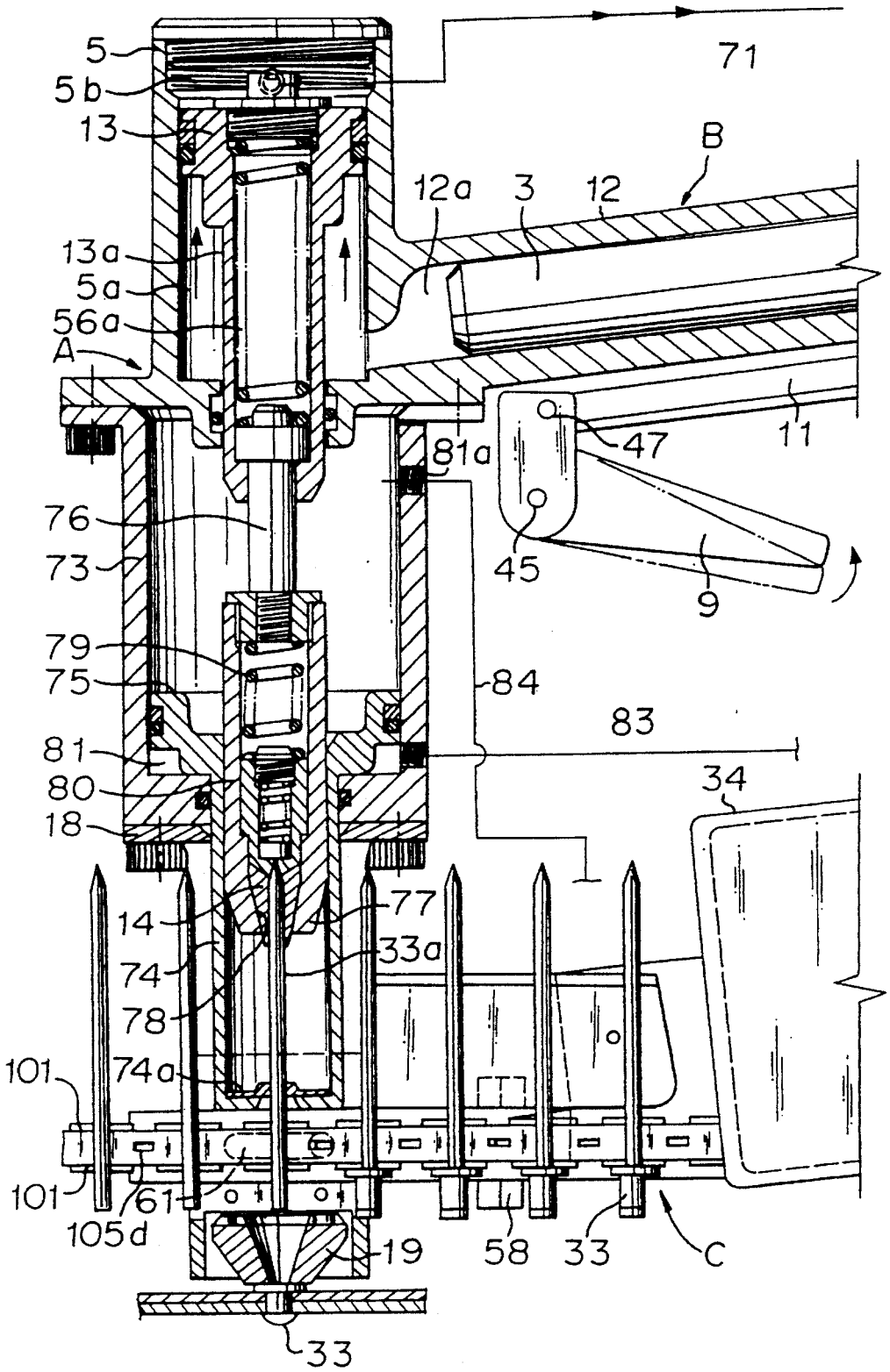
FIG. 23 shows a sectional view of the main body section and rivet-supply section of the continuous riveting machine applying the conventional rivet-holding belt. This drawing also shows the operating lever installed in the riveting machine being gripped.
Figure 24:
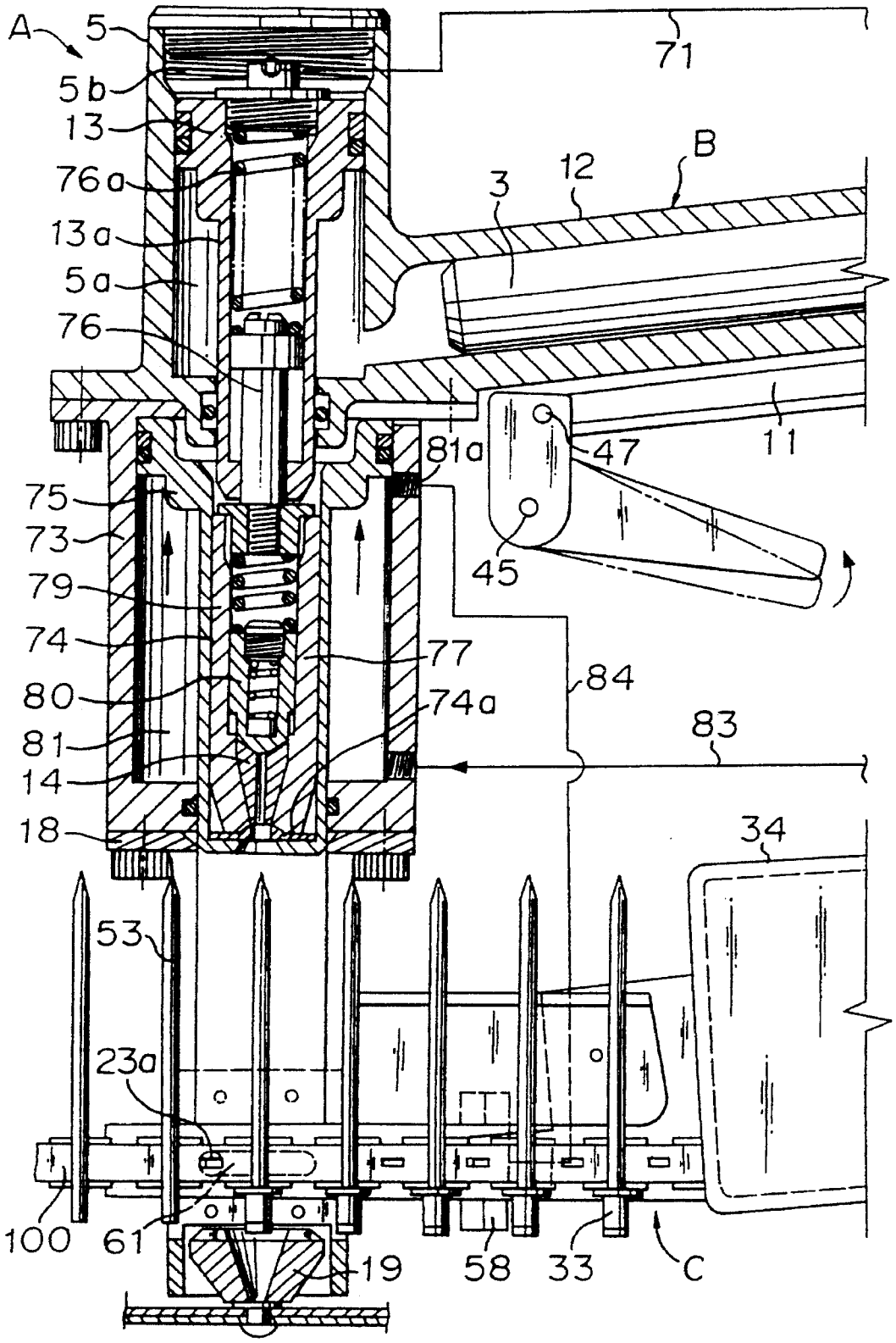
FIG. 24 shows a sectional view of the main body section and rivet supply section of the continuous riveting machine applying the conventional rivet-holding belt. This drawing also shows the operating lever installed in the riveting machine being gripped.
Figure 25:
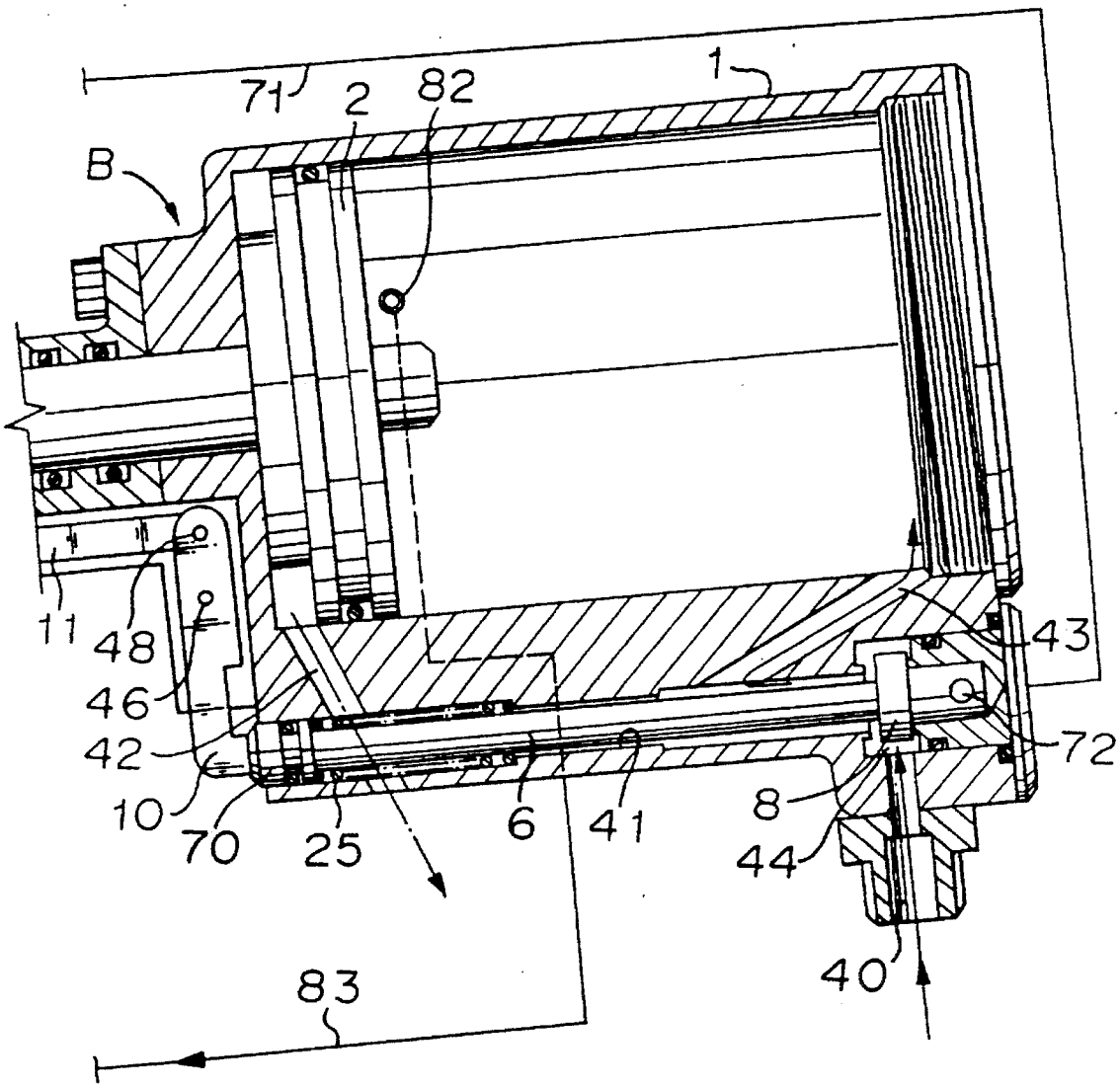
FIG. 25 shows a sectional view of the drive section of the continuous riveting machine applying the conventional rivet-holding belt, and by combining FIG. 25 with FIG. 24, the riveting machine is displayed as a whole.
Figure 26:
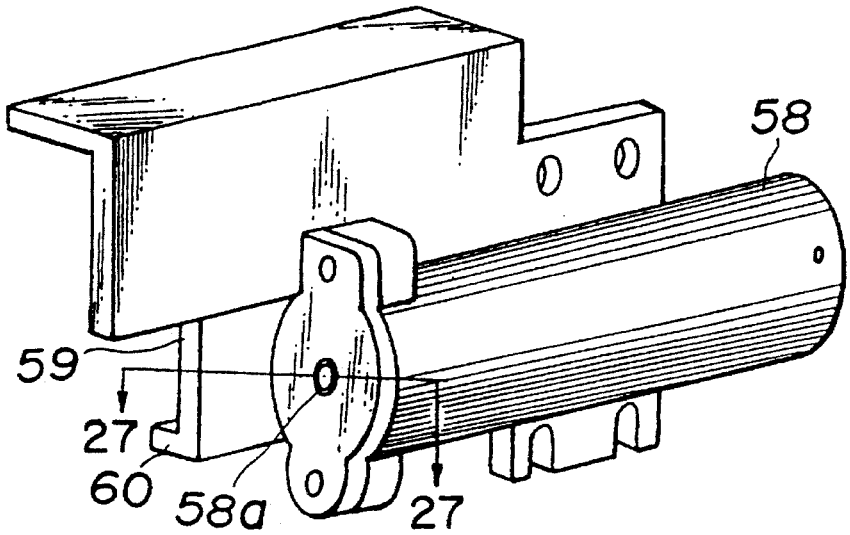
FIG. 26 shows a perspective view of the rivet supply section of the continuous riveting machine applying the conventional rivet-holding device.
Figure 27:
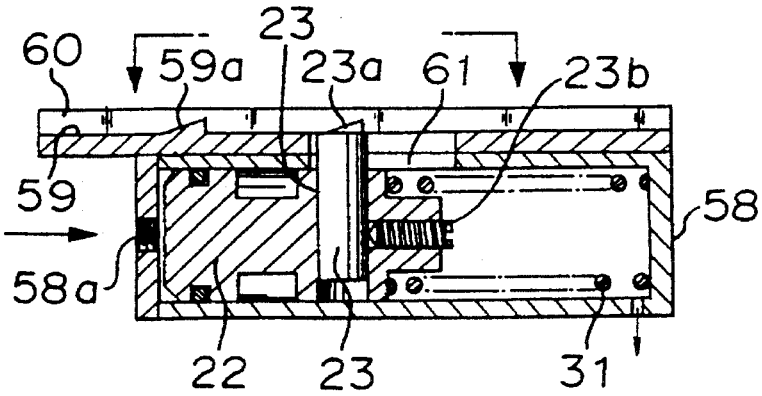
FIG. 27 shows a sectional view taken along line 27—27 of FIG. 26.
Figure 28:
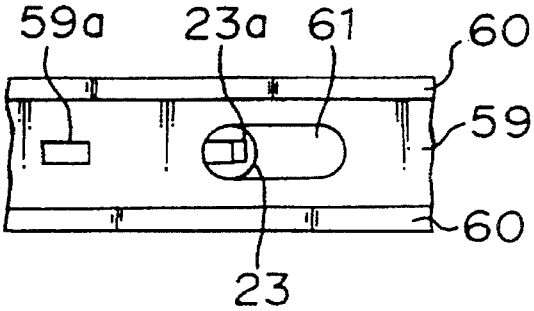
FIG. 28 shows a part of the guide plate looked at from the arrows H, H.
Figure 29:
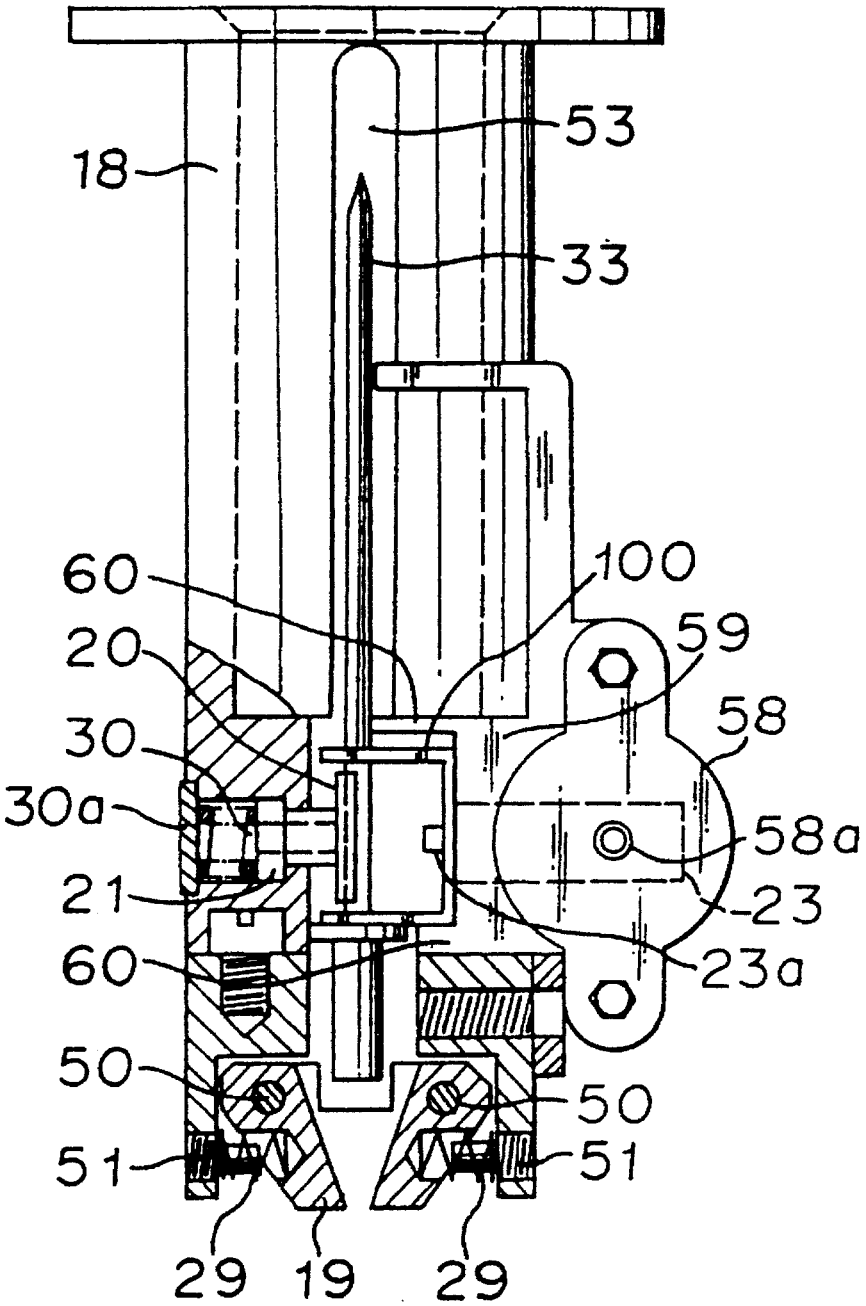
FIG. 29 shows a right-hand side view of the rivet-supply section of the continuous riveting machine applying the conventional blind rivet-holding belt.
Figure 30:
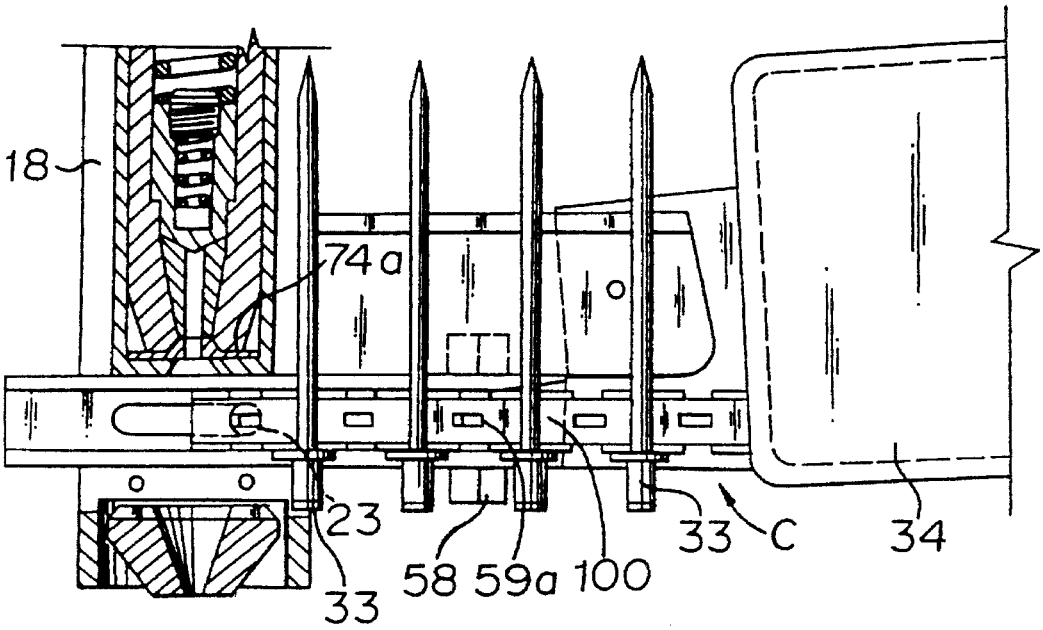
FIG. 30 shows an explanatory drawing showing the portion around the rivet-supply section of the continuous riveting machine provided with the conventional blind rivet-holding belt.

FIG. 10 shows the main body section and the rivet supply section of the continuous riveting machine, and shows that the operating lever (not shown) installed in the machine is released and the trigger valve is positioned in the normal position. FIG. 11 shows a sectional view of a pneumatic and hydraulic cylinder of the riveting machine, and FIG. 12 shows an air circuit of the riveting machine. By combining FIG. 12 with FIG. 10 and FIG. 11, the riveting machine is displayed as a whole. FIG. 13 shows a sectional view of the main body section and the rivet supply section of the continuous riveting machine, and shows that the position of a control valve 900 is in the same position shown in FIG. 12 in spite of the fact that the trigger valve 800 is switched by gripping the operating lever installed in the riveting machine. FIG. 14 shows a sectional view of the drive section of the riveting machine, and FIG. 15 shows an air circuit of the riveting machine. By combining FIG. 15 with FIG. 13 and FIG. 14, the riveting machine is displayed as a whole. FIG. 16 shows a sectional view of the main body section and the rivet supply section of the riveting machine, and shows the trigger valve 800 and the control valve 900 being switched together. FIG. 17 shows a sectional view of the driving section of the riveting machine, and FIG. 18 shows another state of the air circuit of the riveting machine. By combining FIG. 18 with FIG. 16 and FIG. 17, the riveting machine is displayed as a whole. FIG. 19 shows a sectional view of the rivet supply section of the riveting machine. FIG. 20 shows the main body section and the rivet supply section of the riveting machine with the rivet core stem of the blind rivet inserted in the nose piece of the riveting machine being held by a holding pin 632 and the plate spring 633.

The continuous riveting machine is comprised of a main body section D, a driving section E and a valve section G.

By combining FIG. 10 to FIG. 12, the riveting machine is shown with the operating lever being released, and by combining FIG. 13 to FIG. 15, the riveting machine shows the operating lever (not shown) gripped and only the trigger valve 800 is being switched, and further shown, by combining FIG. 16 to FIG. 18, is the riveting machine with the operating lever (not shown) ripped, and both the trigger valve 800 and the controlling valve 900 are being switched.

As shown in FIG. 10 and FIG. 11, the driving section E of the continuous riveting machine is comprised of a small diametral hydraulic cylinder 210 branched sidewise from said main body section D, and a large diametral air cylinder 200 driving a piston 211 inserted in the hydraulic cylinder 210, and a pneumatic and hydraulic cylinder 300 connected to the rear end of the air cylinder 200.

Furthermore, the piston 211 inserted in the hydraulic cylinder 210 is integrated in one piece with the piston 220 inserted in the air cylinder 200.

In the pneumatic hydraulic cylinder 300, a low pressure piston 300 is inserted therein, and an oil chamber 310 and an air chamber 320 are separated by the piston 300.

The oil cylinder 210 is connected to the first oil port 470 of the oil chamber 450 in a chuck cylinder 400, and the oil chamber 310 in the pneumatic hydraulic cylinder 300 is connected to a secondary oil port 480 placed under the first oil port 470.

On the front position of the air cylinder 200 an air port c connecting to the pilot port x of the control valve 900 via an air path 3 is installed, and on the rear portion of the air cylinder 200 an air port a connected to the port e of the control valve 900 via an air path 1 is installed.

Further, on the rear portion of the pneumatic hydraulic cylinder 300, an air port b is installed for supplying the pressurized air to an air port of the control valve 900 via an air path 2, and on the middle portion of the pneumatic hydraulic cylinder 300, a port d is installed for shutting the air flow into an air path 4 by the axial movement of the piston 330, and the air path 4 is respectively connected to an air inlet of a vacuum air ejector 420 shown in FIG. 10 and to an air port p of a rivet feed air cylinder 710 (shown in FIG. 19).

On the rear under portion of the pneumatic hydraulic cylinder 300, a rivet containing magazine 750 belonging to the rivet supply section F is pivotally supported by a pin 340 as shown in FIG. 11.

In referring to the main body D of the continuous riveting machine, the chuck cylinder 400 is in general rectangularly integrated in one piece with the oil cylinder 210, and a transparent case 410 storing the torn core stem 741 of the blind rivet 740 is installed above the chuck cylinder 400 and the rivet supply section F is installed under the chuck cylinder 400.

The inner portion of the chuck cylinder 400 is divided into an upper air chamber 440 and a lower oil chamber 450 by a jaw case piston 500 energized downwardly by the spring 490.

On the upper wall of the chuck cylinder 400, a hole 430 introducing the torn core stem 741 of the blind rivet into the case 410 is located, and on the upper side wall an air port 460 connected to the vacuum side of the vacuum air ejector 420 for vacuuming the transparent case 410 is shaped.

In the jaw cylinder 400, a nose piston 600 is placed under the jaw case piston 500, and the cylindrical body 610 integrated in one piece with the nose piston 100 at the under portion thereof is slidably inserted in a bottom wall of the chuck cylinder 400, and on the bottom end of the cylindrical body 610 a nose piece 620 is attached.

Shaped on the lower side wall of the chuck cylinder 400 are a first port 470 connected to the oil chamber 450 and a second port 480.

A cylindrical jaw case 510 is integrated in one piece with the jaw case piston 500 and the jaw case 510 has a bored tip, and a tapered surface 511 converging toward the tip portion is shaped in an inner wall of the jaw case 510, and further, a pair of jaws are slidably inserted in the tapered surface 511.

Each of the jaws is downwardly and externally energized by a spring 520 via sharp edged jaw pusher 530.

In the state shown in FIG. 10, FIG. 16 and FIG. 20, the tip portion of the jaw case 510 is contacted to the bottom wall 611 of the cylindrical body 610, and the tips of the jaws 540 are contacted to the nose piece 620 extruded upwardly.

A hole 740 for passing the rivet core stem 741 of the blind rivet 740 therein is bored in the nose piece 620, and an elastic ring 621 is installed in the tip portion of the hole 740 for slidably holding the core stem of the blind rivet by the elastic property thereof, so as to prevent the blind rivet from falling during the riveting operation.

Instead of holding the core stem 741 by the elastic ring 621, it is possible to construct a holding pin 632 at the side portion of the core stem 741 rectangular to the stem 741, to longitudinally install a plate spring 633 at the outer side thereof, and to deprive the biasing force of the holding pin 632 when the nose piece 630 ascends to the upper dead point.

As shown in FIG. 10, FIG. 13, FIG. 16 and FIG. 19, the rivet supply section F of the continuous riveting machine has a rivet feed air cylinder 710 and a guide plate 720. The blind rivet-holding belt 730 is shaped like a channel made of plastic material such as polypropylene, and has a plurality of the feed holes 732 and a plurality of the tabs 731*a* and 731*b* installed on both ends of the web thereof in every prescribed distance.

Between one tab and the neighboring tab, a cut groove is placed, and on the each tip portion of the upper and lower tabs 731*a*, 731*b*, an opening is shaped. In these openings, the core stem 741 and the rivet main body 741 are respectively supported.

As shown in FIG. 19, in the rivet feed air cylinder 710, a rivet feed piston 712 biased forwardly by a spring 711 is inserted in the air cylinder 710, and in the piston 712, a core pin 713 having a feed pawl 713*a* is inserted therein, and the pin 713 is set therein by a small threaded screw 714 for preventing the pin 713 from falling out.

On the guide plate 720 are provided a pair of extrusions 721 for guiding the blind rivet-holding belt 730, a long hole 722 in which the feed pawl 713*a* reciprocates therein, and a reverse motion-preventing pawl 723.

Also, the blind rivet-holding belt 730 is elastically pressed toward the guide plate 720 by the plate string (not shown) for preventing the belt 730 from deviation. This plate spring elastically presses the blind rivet-holding belt 730 toward the guide plate 720 and prevents the deviation of the belt 730 from the specified position.

The belt-containing magazine 750 is constructed the same as that of the conventional riveting machine.

The valve section G of the continuous riveting machine applying the rivet-holding belt according to the present invention is comprised of the pressurized air-supplying system shown in FIG. 12, FIG. 15 and FIG. 18. The control valve 900 is a 4-port 2-stage pilot-operated change valve having the pilot air ports X and Y, and the trigger valve 800 is the 4-port 2-stage change valve manually changed by the trigger lever installed in the riveting machine.

In these drawings, numeral 801 identifies the pressurized air source such as the compressor, and numeral 940 and 830 identify respectively a silencer placed on each of exhaust ports h and o.

Further, the port e, port f and the pilot port x of the control valve 900 are connected respectively to port a, port b, and port e of the driving section E through the air paths 1, 2 and 3.

The working of the continuous riveting machine applying the blind rivet-holding belt according to the present invention is next described as follows.

The blind rivet-holding belt 730 is usually contained in the magazine 750, and before riveting, this riveting machine is in the state shown in FIG. 10 to FIG. 12. Namely, the operating lever (not shown) is released, and the blind rivet 740 is elastically held in the nose piece 620 by the elastic ring 621 so as not to fall downwardly.

When holding the blind rivet 740 with the holding pin 632 and the plate spring 633 as shown in FIG. 20, at the upper dead point of the ascended nose piece 620, the biasing force of the plate spring 633 against the holding pin 632 is released by escaping the plate spring 633, but excepting this point, the blind rivet 740 is elastically held in the nose piece.

In this condition, as shown in FIG. 10, in inputting the main body of the blind rivet into the hole of the steel sheets 760 to be riveted, and in gripping the operating lever (not shown), the trigger valve 800 is shifted to the stage shown in FIG. 15, then the pressurized air passes through the port s and the port n of the trigger valve 800, the port g and the port e of the control valve 900, and flows in the rear air chamber of the air cylinder 200 from the air port a via the air path 1 as shown in FIG. 14. As the high pressure piston 211 advances, the oil in the oil chamber 212 flows in the first port 470 of the chuck cylinder 400 as shown in FIG. 13, then the jaw case piston 500 is raised up as much as specified.

Accordingly, the jaw case 510 is raised. In this case, as a pair of jaws 540 are biased downwardly by the spring 520 via the jaw pusher 530, the jaws 540 extrude downwardly while sliding in the tapered surface 511 of the jaw case 510, and rise upwardly while gripping the core stem 741 of the blind rivet 740 by approaching each other toward the center of the jaws by pulling up the core stem 71, the fastening of the blind rivet is performed. The core stem 741 is simultaneously torn from the blind rivet 740 at the tip end of the nose piece 620.

In this case, as the air port b located on the side of the pneumatic hydraulic cylinder 300 is connected to the silencer 940 via the air path 2 and the air ports f and h of the control Valve 900, the hydraulic oil in the second port 480 is depressurized. Then the nose piston 600 is pressed to the bottom end of the chuck cylinder 400 as shown in FIG. 13.

As above-described, in advancing the piston in the air cylinder 200, as the pressurized air flows in the pilot path X of the control valve 900 via the air port c, the air path 3, then the control valve 900 is shifted in the state shown in FIG. 18, the pressurized air from the air source 801 is charged in the air chamber 320 of the pneumatic hydraulic cylinder 300 through the ports s, m of the trigger valve 800, the ports g, f of the control valve 900 and the air path 2, then the low pressure piston 330 advances.

Accordingly, as shown in FIG. 16, at first the nose piston 600 ascends by the oil flow from the second port, and as the high pressure piston 211 retracts backwardly by the oil flow into the oil cylinder 210, the nose piston 600 ascends further against the jaw case piston 500. Further, simultaneous to contacting the bottom wall 611 of the cylindrical body 610 to the bottom end of the jaw case 510, the cylindrical body 610 raises the tips of the jaws 540, then the jaws 540 are released, and in this condition, the jaw case piston 500 and the nose piston 600 ascend together to each upper dead point.

In this time, the pressurized air in the air chamber 440 located above the chuck cylinder 400 is discharged into the air through the upper port 406.

When the low pressure piston 330 reaches the stroke end, as the air port d of the pneumatic hydraulic cylinder 300 is opened, the pressurized air is supplied to the vacuum air ejector 420 shown in FIG. 16 and to the rivet feed air cylinder 710 from the air port d through the air path 4. Accordingly, as the inside space of the case 410 becomes vacuum, then as shown in FIG. 16, the torn rivet core stem 741 is absorbed into the case 410. Simultaneously, the piston 712 inserted in the rivet feed air cylinder 710 advances, the feed pawl 713a also advances along the long hole 722 of the guide plate, and the feed pawl 713a engaging with the feed hole 732 of the blind rivet-holding belt 730 takes out the belt 730 from the magazine 750, and transfers the belt 730 along the intrusions 721 of the guide plate 720 as much as one pitch, then sets the tip of the core stem 741 on the axis center under the nose piece 620.

Next, in releasing the operating lever (not shown), the valve section changes to the state shown in FIG. 12, then because the trigger valve 800 returns to the original position by the spring 820, the pressurized air delivered from the air source 810 is introduced to the pilot path Y of the control valve 900 via the air ports s, m, then also the control valve 900 returns to the original normal position as shown in FIG. 12. Then the pressurized air in the rear air chamber 230 of the air cylinder 200 is discharged into the air through the air port a, the air path 1, the air ports e, g of the control valve 900, the air ports n, o of the trigger valve 800 and the silencer 830.

Furthermore, the pressurized air in the air chamber 320 of the pneumatic hydraulic cylinder 300 is discharged into the air through the air port b, the air path 2, the ports f, h of the control valve 900 and the silencer 940.

As above mentioned, because the pressurized air in the rear air chamber 230 of the air cylinder 200 and air chamber 320 of the pneumatic hydraulic cylinder 300 is altogether discharged into the air, then the jaw case piston 500 and the nose piston 600 descend by the biasing force of the spring 490. In this case, the core stem 741 of the blind rivet 740 is held in the opened jaws 540 released by the nose piece 620, and the tip of the nose piece 620 descends while downwardly bending the upper and lower tabs 731*a*, 731*b* of the blind rivet-holding belt 730.

In this time, as shown in FIG. 4, because the lower tab 731*b* is supported by the extrusion 721 of the guide plate 720, the core stem 741 of the blind rivet 740 is easily inserted into the nose piece 620 through the elastic ring 621 by the resistance due to the extrusion 721 and the head 742*a* placed on the inside of the lower tab 731*b*.

Further, as the pressurized air in the tape feed air cylinder 710 is discharged to the air path 2 via the port p, the air path 4, the port d of the pneumatic hydraulic cylinder 300, and the port b, then the piston 712 retracts to the original position by the spring 711. However, as the blind rivet-holding belt 730 is prohibited from moving toward the reverse direction by the reverse motion-preventing pawl 723, then while the belt 730 stays in that position only the feed pawl 713*a* is disengaged from the feed hole 732 and is transferred backwardly as much as one pitch and engages with the another feed hole retracted as much as one pitch. In this case, as the blind rivet-holding belt 730 is elastically pushed to the guide plate 720 by the plate spring (not shown) for preventing the belt 730 from deviating, the feed pawl 713a securely engages with the feed hole 732 of the belt 730.

As above-mentioned, all the necessary preparations for riveting the blind rivet 740 are complete. The succeeding operations are the same as before described, and by repeating these operations, it is possible to continuously rivet the blind rivets 740.

According to the above-described present invention, the following effects are realized:

(1) When the cylindrical body and the nose piece attached to the tip of the body are descending and bend the upper and lower tabs of the blind rivet-holding belt, it is possible for the blind rivet elastically held in the nose piece to leave from the openings of the upper and lower tabs holding it up to that time. Accordingly, as the cylindrical body does not work by holding the blind rivet-holding belt therein as the conventional riveting machine, then it is possible to apply the conventional inexpensive blind rivet provided on the market.

(2) As the head portion of the blind rivet is placed on the inside of the lower tab of the blind rivet-holding belt, in descending the cylindrical body, the blind rivet is prevented from descending together with the nose piece, and as a result the core stem of the blind rivet is smoothly inserted into the nose piece.

What is claimed is:

1. A blind rivet-holding belt, for holding a plurality of rivets each having a rivet head for use in a continuous riveting machine having a nose piece, made of plastic material generally in the form of a U-shaped channel, having a long web with feed holes at predetermined intervals in a plurality of outwardly extending planar tabs integral with oppositely disposed parallel upper and lower edges of the long web and provided at predetermined equal intervals with a groove midway of each said predetermined intervals, comprising:

a plurality of first holes in said upper planar tab for holding a core stem of a plurality of blind rivets, a plurality of second larger holes in said lower planar tab for holding a main body of said plurality of blind rivets;

a first V-shaped opening, and each tab integral with said upper edge, terminating at said first hole;

a second V-shaped opening, in each tab integral with said lower edge, terminating at said second hole; and said grooves being shaped so that none of said planar tabs interfere with others when said belt is spirally wound to a predetermined diameter with said web being oriented outwardly; and said rivet heads being disposed on the inside of said lower planar tab, whereby each said lined rivet is precluded from descending or moving with said nose piece when each said blind rivet is inserted and loaded into said nose piece for use by a continuous riveting machine.

2. A blind rivet-holding belt according to claim 1 wherein said groove is V-shaped.

3. A blind rivet-holding belt according to claim 1 wherein said groove is shaped as a straight slit.

4. A blind rivet-holding belt according to claim 1 or claim 2, wherein the terminations of said first and second V-shaped openings at said first and second holes are slightly smaller, respectively, than a core stem diameter and rivet main body diameter of said blind rivets.

* * * * *